US007927236B2

(12) United States Patent
Brunton et al.

(10) Patent No.: US 7,927,236 B2
(45) Date of Patent: Apr. 19, 2011

(54) METHOD OF TRAINING A GOLFER TO CORRECTLY POSITION THEIR HANDS ON A GOLF CLUB GRIP

(75) Inventors: Henry Brunton, King City (CA); Robert G. Dickie, King City (CA); Qian Wang, King City (CA)

(73) Assignee: Brunton Innovations Inc., King City, Ontario (CA)

( * ) Notice: Subject to any disclaimer, the term of this patent is extended or adjusted under 35 U.S.C. 154(b) by 0 days.

(21) Appl. No.: 12/706,375

(22) Filed: Feb. 16, 2010

(65) Prior Publication Data

US 2010/0151973 A1 Jun. 17, 2010

Related U.S. Application Data

(63) Continuation of application No. 12/168,617, filed on Jul. 7, 2008, now Pat. No. 7,708,648, which is a continuation-in-part of application No. 11/474,751, filed on Jun. 26, 2006, now Pat. No. 7,537,525.

(51) Int. Cl.
*A63B 69/36* (2006.01)

(52) U.S. Cl. ..... 473/409; 473/206

(58) Field of Classification Search ..... 473/201–206, 473/219–223, 226, 409
See application file for complete search history.

(56) References Cited

U.S. PATENT DOCUMENTS

| | | | | |
|---|---|---|---|---|
| 1,664,257 | A | 3/1928 | McCullough | |
| 2,484,762 | A * | 10/1949 | Strazza | 473/206 |
| 2,628,100 | A | 2/1953 | Beebe | |
| 3,227,455 | A | 1/1966 | Hulsman | |
| 3,253,829 | A | 5/1966 | Ford | |
| 3,256,023 | A | 6/1966 | Frazelle | |
| 3,806,130 | A | 4/1974 | Jacques | |
| 4,167,268 | A | 9/1979 | Lorang | |
| 4,884,813 | A | 12/1989 | Cates | |
| 5,152,533 | A | 10/1992 | Radakovich | |
| 5,228,695 | A | 7/1993 | Meyer | |
| 5,295,688 | A * | 3/1994 | Montgomery | 473/206 |
| 5,439,217 | A | 8/1995 | Ganger, Sr. | |
| 5,524,892 | A | 6/1996 | Karp | |
| 5,605,509 | A | 2/1997 | Gray | |
| 5,681,993 | A | 10/1997 | Heitman | |
| 5,762,563 | A | 6/1998 | Holzhausen | |

(Continued)

FOREIGN PATENT DOCUMENTS

| | | |
|---|---|---|
| DE | 3720054 | 12/1988 |

(Continued)

*Primary Examiner* — Nini Legesse
(74) *Attorney, Agent, or Firm* — Sand & Sebolt

(57) ABSTRACT

A method of using a golf training aid to train a golfer to correctly position their hands on the grip of a golf club. The training aid is temporarily engaged on the grip in the correct position by aligning a positioning aid on the training aid with the ball-striking of the club. The correct positioning of the hands is ensured by providing thumb and finger placement indicators on the training aid. The golfer is trained to use the correct amount of force to hold the club by heeding pressure sensors provided in the training aid.

26 Claims, 21 Drawing Sheets

U.S. PATENT DOCUMENTS

| | | | | |
|---|---|---|---|---|
| 5,788,582 | A * | 8/1998 | Shapiro | 473/220 |
| 5,897,441 | A | 4/1999 | Apthorp | |
| 5,984,795 | A | 11/1999 | Stafford | |
| 6,705,951 | B2 | 3/2004 | Beauregard | |
| 6,921,340 | B2 | 7/2005 | Dickie | |
| D520,091 | S | 5/2006 | Leadbetter et al. | |
| 7,252,596 | B1 | 8/2007 | Matousek | |
| 2002/0151373 | A1 | 10/2002 | Beauregard | |
| 2007/0298899 | A1 | 12/2007 | Wang | |

FOREIGN PATENT DOCUMENTS

| | | |
|---|---|---|
| GB | 322512 | 12/1929 |
| GB | 2386326 | 9/2003 |
| JP | 08243201 | 9/1996 |
| WO | 9727913 | 8/1997 |
| WO | 02094388 | 11/2002 |

* cited by examiner

METHOD OF TRAINING A GOLFER TO CORRECTLY POSITION THEIR HANDS ON A GOLF CLUB GRIP

CROSS-REFERENCE TO RELATED APPLICATIONS

This is a Continuation of U.S. patent application Ser. No. 12/168,617, filed Jul. 7, 2008, which is a Continuation-in-Part of U.S. patent application Ser. No. 11/474,751, filed Jun. 26, 2006, now U.S. Pat. No. 7,537,525, the specifications of which are incorporated herein by reference.

BACKGROUND OF THE INVENTION

1. Technical Field

This invention generally relates to training aids for athletes and players and methods of using the same. More particularly, the invention relates to a method of training a golfer using a training aid. Specifically, the invention relates to a method of training a golfer to correctly position their hands on a golf club grip and to apply the correct pressure on the grip while learning to accurately play a stroke in a particular direction.

2. Background Information

It is the opinion of some professional golfers that most amateur golfers hold their golf clubs improperly and this tends to impede the accuracy of their swing. They way they hold the club needs to be corrected before the amateur golfer can really work on their swing and see substantial improvement. However, the golfer may have improperly held their club for many years and a few hours lessons with a golf professional cannot correct years of improper habit. A number of devices and training methods have been proposed in the prior art to aid in correcting the golfer's hold on the club grip. A number of these training aids assist the golfer in holding the club correctly while the aid is attached to the club, but as soon as the aid is removed, the golfer returns to their old habits. If the golfer is able to play many games over a period of time with a suitable training aid, the golfer's muscle memory would be reset and corrected and the training aid would only be required occasionally to verify that the golfer's hold on the grip has been corrected.

There is therefore a need in the art for an improved golf training aid that will enable a golfer to position their hands on the club's grip correctly and will, over the course of time, retrain the golfer's muscle memory to maintain the correct hold on the grip even when the training aid is removed therefrom.

SUMMARY OF THE INVENTION

A method of using a golf training aid to train a golfer to correctly position their hands on the grip of a golf club. The training aid is temporarily engaged on the grip in the correct position by aligning a positioning aid on the training aid with the ball-striking of the club. The correct positioning of the hands is ensured by providing thumb and finger placement indicators on the training aid. The golfer is trained to use the correct amount of force to hold the club by heeding pressure sensors provided in the training aid.

The golf training aid includes a first positioning aid having an indicator that is visually alignable with a portion of the club. When the indicator is so aligned, the training aid is used to correctly position the golfer's hands around the circumference of a club handle. The device further aids in setting the correct interrelationship between the golfer's upper and lower hands and correctly sets the rotation of the hands to the heel of the golf club head. The training aid further corrects the placement of the golfer's hands along the linear axis of the club and aids in training the golfer to apply the correct pressure to the golf grip throughout their swing.

A first embodiment of the training aid is designed for use on full-swing clubs such as irons and drivers. This first embodiment incorporates a pop-up rotation gauge to assist in setting the training aid at a neutral position. The second embodiment of the training aid is designed for use on clubs that will not pass through a full swing, specifically putters. All putter grips have a planar section that is aligned with the club face. The training aid for putters has a corresponding planar section to automatically align the training aid to the neutral position. The second embodiment does not have a pop-up rotation indicator.

Each of the first and second embodiments of the present invention may include one or more electronic pressure sensors that will generate an audible sound through a speaker when the pressure exerted by the golfer's fingers exceeds a preset limit.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

DETAILED DESCRIPTION OF THE INVENTION

Figure 1:
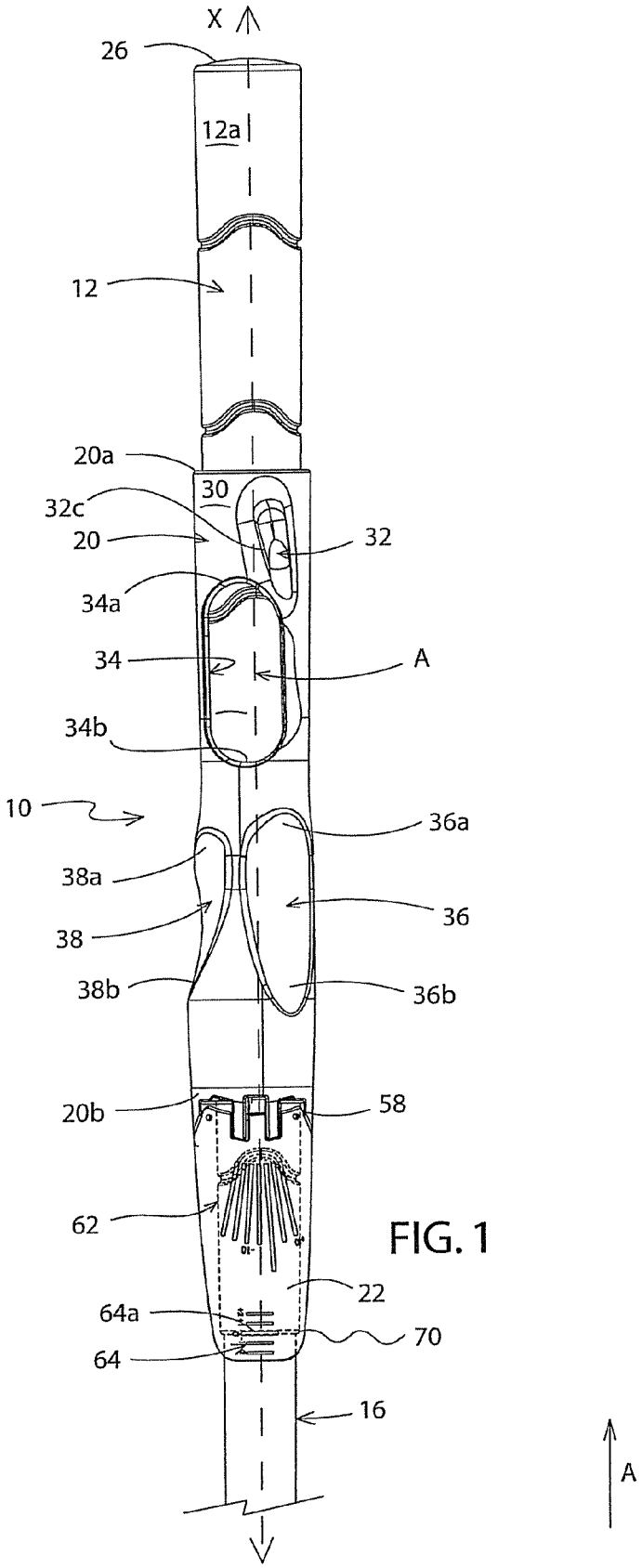
FIG. 1 is a front view of a golf training aid in accordance with the present invention engaged with the grip of a full-swing golf club.

Referring to FIGS. 1-13 there is shown a golf training aid in accordance with the present invention and generally indicated at 10. Training aid 10 is designed to be used on a golf club 14. Club 14 includes a head 18, a shaft 16 and a grip 12. Grip 12 has an uppermost end 26 and an innermost end 70 and is generally circular in cross-sectional shape. Grip 12 therefore has a circumferential component and a linear component. The linear component is generally aligned with the longitudinal axis "X" of club 14. The circumferential component is generally at right angles to the longitudinal axis "X" of club 14.

The training aid 10 in accordance with the present invention is designed to be engaged around the exterior surface 12 of the pre-existing grip 12 of club 14. Training aid 10 is not permanently affixed to grip 12 but is temporarily engageable therewith when the golfer wishes to practice his or her game. Specifically, training aid 10 is designed to aid the golfer in correctly positioning their upper and lower hands on grip 12. The term "upper hand" as used herein is meant to identify the one of the golfer's hands that is closest to the uppermost end 26 of club 14. The term "lower hand" as used herein is meant to identify the one of the golfer's hands that is closest to the head 18 of club 14. Specifically, training aid 10 is designed to aid the golfer to correctly place their fingers around the circumference of the grip 12. Furthermore, training aid 10 is designed to aid the golfer to correctly position the fingers and thumb of their upper hand in relationship to the fingers and thumb of their lower hand. Still further, training aid 10 is provided to correct the rotation of both upper and lower hands relative to the heel of the golf club head. The upper and lower hands may have a strong, weak or neutral grip rotation and only the neutral rotation is correct. Training aid 10 is designed to aid the golfer in having this neutral rotation. Training aid 10 is additionally designed to aid in teaching the golfer to correctly position their hands along the longitudinal axis of the golf grip and to apply the correct pressure to the grip throughout the swing of club 14.

In accordance with the present invention, training aid 10 comprises a body 20 that is molded to include components that will aid the golfer in correctly positioning both the upper and lower hands, and more specifically to correctly position the fingers and thumbs thereof. Body 20 is provided with a first positioning aid in the form of a pop-up member 22. Pop-up member 22 is used to correctly position the training aid on the circumference of grip 12 so that training aid 10 and therefore the golfer's hands are correctly positioned relative to a portion of the club. Specifically, pop-up member 22 enables the golfer to engage training aid 10 on grip 12 in a neutral position relative to the heel of the club.

Preferably, body 20 is manufactured from a flexible plastic such as polypropylene and pop-up member 22 is manufactured from a clear plastic such as a polycarbonate so that an indicator on pop-up member 22 can be visually aligned with a portion of club 14. Pop-up member 22 is pivotably mounted onto body 20 as will be hereinafter described and is movable between a play position, shown in FIGS. 1-3, and a set-up or non-play position, shown in FIGS. 7 and 8.

Body 20 has a proximal end 20*a* and a distal end 20*b* and is of a length "L" as measured between proximal and distal ends 20*a*, 20*b*. Body 20 also has a longitudinal axis "X" that extends between proximal and distal ends 20*a*, 20*b* and is substantially alignable with the longitudinal axis "Y" (FIG. 2) of golf club 14. Body 20 further has a first and a second side edge 20*c*, 20*d* that are spaced a distance away from each other and are generally equidistant from a centerline "A" (FIG. 6) of said body 20. Centerline "A" is generally parallel to the longitudinal axis "X" and when body 20 is engaged on grip 12, the longitudinal axis "X" of body 20 is generally coaxial with the longitudinal axis "Y" of golf club 14.

Body 20 is a thin, flexible member that is substantially C-shaped in cross-section and has an interior surface 28 and an exterior surface 30. At least interior surface 28 is configured to be complementary in cross-sectional shape to a portion of the circumferential exterior surface 12*a* of grip 14 and to be frictionally engaged therewith. Exterior surface 30 is molded with contoured features that designate the correct positions and orientations for the golfer's thumbs and fingers, and therefore the correct positions for both the upper and lower hands.

The first of such contoured features provided on body 20 is a protrusion 32 that extends upwardly and outwardly away from exterior surface 30. Protrusion 32 is useful for positioning the thumb of the upper hand. Protrusion 32 is disposed proximate to proximal end 20*a* and may be disposed immediately adjacent proximal end 20*a* or spaced a distance inwardly therefrom. As shown in FIG. 1, protrusion 32 preferably is oriented at an acute angle relative to centerline "A" with a first end 32*a* thereof disposed closer to centerline "A" and a second end 32*b* disposed further away therefrom. Protrusion 32 thus angles away from centerline "A" and toward one of first and second side edges 20*c*, 20*d*. The training aid illustrated in FIGS. 1-13 is designed for use by a right-handed male golfer. Consequently, protrusion 32 angles away from centerline "A" and toward first side edge 20*c*. If the training aid were designed for a left-handed golfer, which is not shown, the protrusion would angle away from centerline "A" and toward second side edge 20*d*. Protrusion 32 is formed with gently rounded edges so that it is comfortable for the golfer to position the side of his or her thumb thereagainst. Specifically, protrusion 32 has a gently rounded inner side wall 32*c* that acts as a rest for the inner side of the thumb of the golfer's upper hand and substantially prevents lateral motion of that thumb. Protrusion 32 extends outwardly away from exterior surface 30 for a distance that is sufficient to prevent the golfer's thumb from accidentally riding vertically over protrusion 32 when a stroke is played.

A second feature provided on training aid 10 for correct placement of the golfer's hands is an aperture 34. Aperture 34 is an elongate oval shape that is defined in body 20 in such a manner that it is generally oriented substantially parallel to longitudinal axis "X" and extends for a distance generally along centerline "A". Aperture 34 extends through both of the exterior and interior surfaces 30, 28 so that when a golfer positions his thumb therein, the thumb comes into direct contact with the exterior surface 12*a* of grip 12. Preferably, and as shown in FIG. 1 herewith, aperture 34 is defined such that a first end 34*a* thereof is disposed adjacent protrusion 32. Preferably, first end 34*a* is situated intermediate the first and second ends 32*a*, 32*b* of protrusion 32 or is at least adjacent second end 32*b* thereof. A second end 34*b* of aperture 34 is disposed a distance away from second end 32*b* of protrusion 32 and further inwardly from end 20*a* of body 20. Thus, second end 32*b* of protrusion 32 is a greater distance away from end 20*a* of body than is second end 32*b* of protrusion 32. Preferably, second end 34*b* of aperture 34 is proximate a midpoint of the length "L" of body 20.

Body 20 is further provided with one or more other contoured features to aid in correct placement of the fingers and thumbs. Specifically, body 20 is further provided with a first pad 36 for placement of the thumb of the lower hand. In this instance, because training aid 10 is designed for use by a right-handed male golfer, first pad 36 is for placement of the right thumb. First pad 36 may be formed as a groove in exterior surface 30 or a contoured region that is clearly delineated in some way so that the golfer can easily identify the same. Body 20 further includes a second pad 38 for placement of a portion of the side of the right index finger. Additionally, body 20 includes a third pad 40 for receiving the tip of the index finger of the lower hand. Pads 36, 38 and 40 are formed in a region of device 10 that is contoured so that it is raised outwardly relative to the region surrounding and defining aperture 34. First pad 36 is generally oval-shaped and extends generally parallel to longitudinal axis "X". First pad 36 has a first end 36*a* that is spaced a distance away from second 34*b* of aperture 34 and a second end 36*b* disposed a distance from first end 36*a*. First end 36*a* is also disposed proximate centerline "A" and first pad 36 extends outwardly from centerline "A" and toward first side edge 20*c*.

Second pad 38 is generally oval in shape and extends generally parallel to the longitudinal axis "X". Second pad 38 has a first end 38*a* disposed a spaced distance from second end 34*b* of aperture 34 and proximate centerline "A". First end 38*a* of second pad 38 is disposed generally adjacent first end 36*a* of first pad 36. First end 38*a* of second pad 38 preferably is spaced further from second end 34*b* of aperture 34 than is first end 36*a* of first pad 36. Furthermore, second pad 38 extends outwardly from centerline "A" and toward second side edge 20*d*. Consequently, second ends 36*b*, 38*b* are spaced laterally further apart from each other than are the first ends 36*a*, 38*a*. A ridge 42 is formed intermediate first pad 36 and second pad 38 with the ridge 42 being generally aligned with longitudinal axis "X". Ridge 42 does not extend outwardly beyond protrusion 32 but is still raised relative to the adjacent portion of body 20.

Third pad 40 is disposed adjacent first side edge 20*c* and extends upwardly toward first pad 36, preferably terminating a short distance away therefrom. Third pad 40 is oriented such that it angles generally from centerline "A" outwardly toward first side edge 20*c*.

It will be understood that protrusion 32, aperture 34, first, second and third pads 36, 38 and 40 are all provided so that when golfer holds club 14 and places the appropriate fingers and thumbs on, in and against these features, their fingers and thumbs, and therefore their hands, will be correctly positioned around grip 12 and will be correctly oriented relative to each other.

Pop-up member 22 is provided to enable the golfer to set the position of his or her hands so that the correct rotation relative to the heel of the club is attainable. Pop-up member 22 preferably is pivotably secured to distal end 20*b* of body 20. Distal end 20*b* includes a pair of spaced-apart buttresses 44 that are separated from each other by a gap 46. Each buttress 44 defines a hole 48 therein and the pair of holes 48 are aligned with each other and are oriented substantially at right angles to the longitudinal axis "X" of body 20. Pop-up member 22 includes a boss 50 on one end that is separated from a pair of spaced-apart abutments 52 by a pair of spaced-apart slots 54. Slots 54 are complementary in size and shape to buttresses 44 and boss 50 is complementary in size and shape to gap 46. Each abutment 52 defines a hole 56 therein that is oriented substantially at right angles to the longitudinal axis "X" and is alignable with holes 48 in buttresses 44. A pin 58 extends through aligned holes 48, 56 to secure pop-up member 22 to body and a spring 60 is engaged with pin 58. This arrangement permits pop-up member 22 to be pivoted between a play position (FIG. 2) and a non-play position (FIG. 7), as will be hereinafter described. Pop-up member 22 is configured so that the inner end 22*a* thereof is complementary to distal end 20*b* of body 20. Outer end 22*b* of pop-up member 22 is generally arcuate in shape.

In accordance with a specific feature of the present invention, pop-up member 22 is provided with a plurality of first indicator lines 62 and a plurality of second indicator lines 64 thereon. First indicator lines 62 are provided to identify the correct hand position relative to the heel of club 14. First indicator lines 62 identify angles that are useful for the golfer to correctly position training aid 10 on the circumference of grip 12 relative to a portion of the club head 18. The lines 62 are useful for positioning training aid 10 correctly relative to the heel of the club so that the golfer can hit a substantially straight ball and can correct the tendency to either hook or slice a ball. First indicator lines 62 include a first line 62*a* that indicates a neutral position or an angle of zero degrees. First indicator lines 62 also include a plurality of first indicator lines 62*b* that indicate a weak, or negative position relative to the heel of the dub as is signified by the negative angle identifiers 63 associated with lines 52. Each line 62*b* as illustrated indicates an angle of an additional negative five degrees off neutral. Finally, first indicator lines also include a plurality of indicator lines 62*c* that indicate a strong, or positive, position relative to the heel of the club as is signified by the positive angle identifiers 65 associated therewith. Each first line 62*c*, as illustrated, indicates an angle of an additional positive five degrees away from neutral. Preferably, pop-up member 22 includes first indicator lines 62 which indicate angles that are as much as 20 degrees positive and 20 degrees negative rotation. The method of using first indicator lines 62 will be described hereinafter.

Second indicator lines 64 are provided on pop-up member 22 to correctly and consistently position training aid 10 linearly on grip 12 and relative to axis "Y" of club 14. Second indicator lines 64 include a primary indicator line 64*a*, one or more second lines 64*b* that are provided on a first side of line 64*a* and one or more second lines 64*c* that are provided on the other side of line 64*a*. Second lines 64*b* and 64*c* indicate possible distances away from the primary indicator line 64*a* and are provided with positive and negative markers to identify their position relative to primary indicator line 64*a*.

Figure 2:
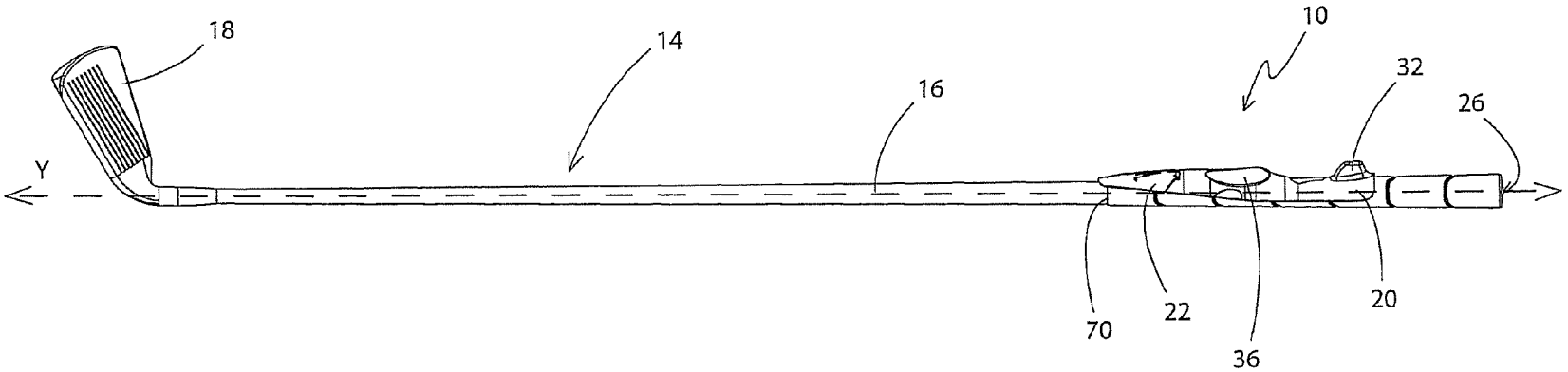
FIG. 2 is a left side view of the golf training aid engaged with the golf club and having a pop-up member thereon in a "flipped down" or play position.
Figure 3:
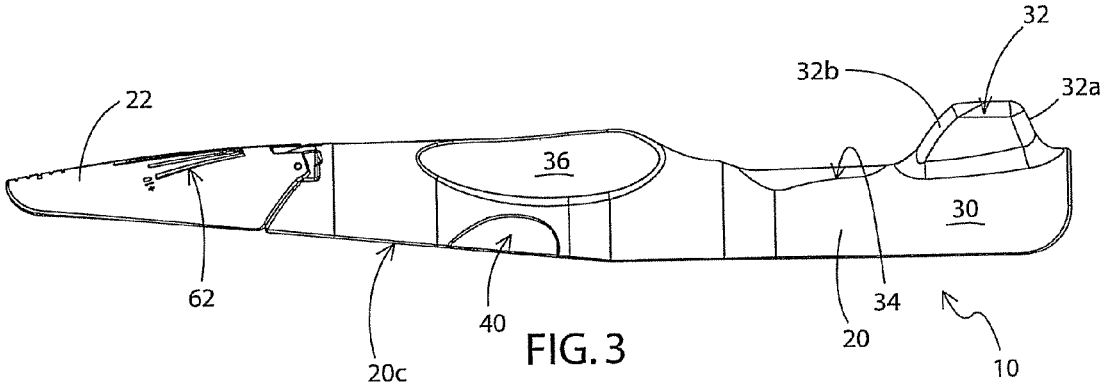
FIG. 3 is a left side view of the golf training aid in accordance with the present invention with the pop-up member in the play position.
Figure 4:
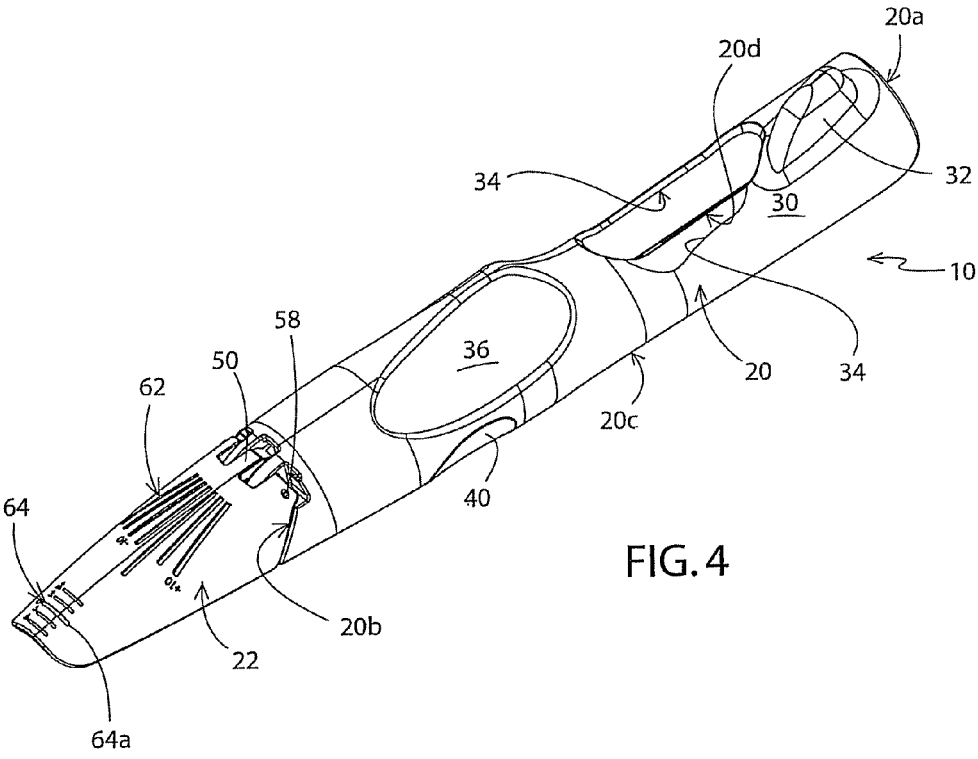
FIG. 4 is a perspective view of the golf training aid of FIG. 3.
Figure 5:
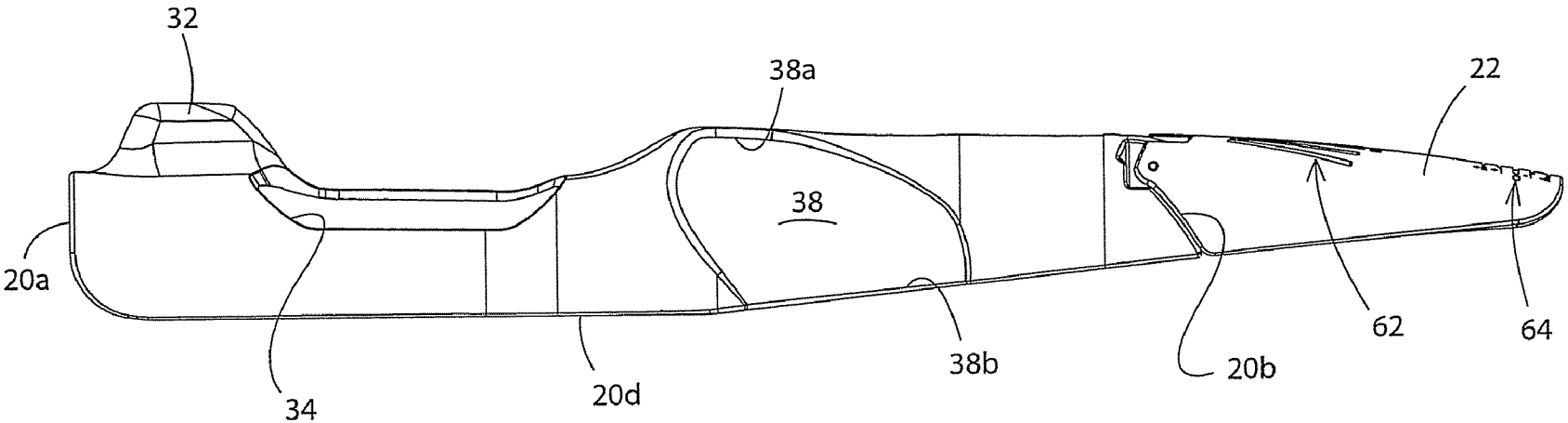
FIG. 5 is a right side view of the golf training aid of FIG. 3.
Figure 6:
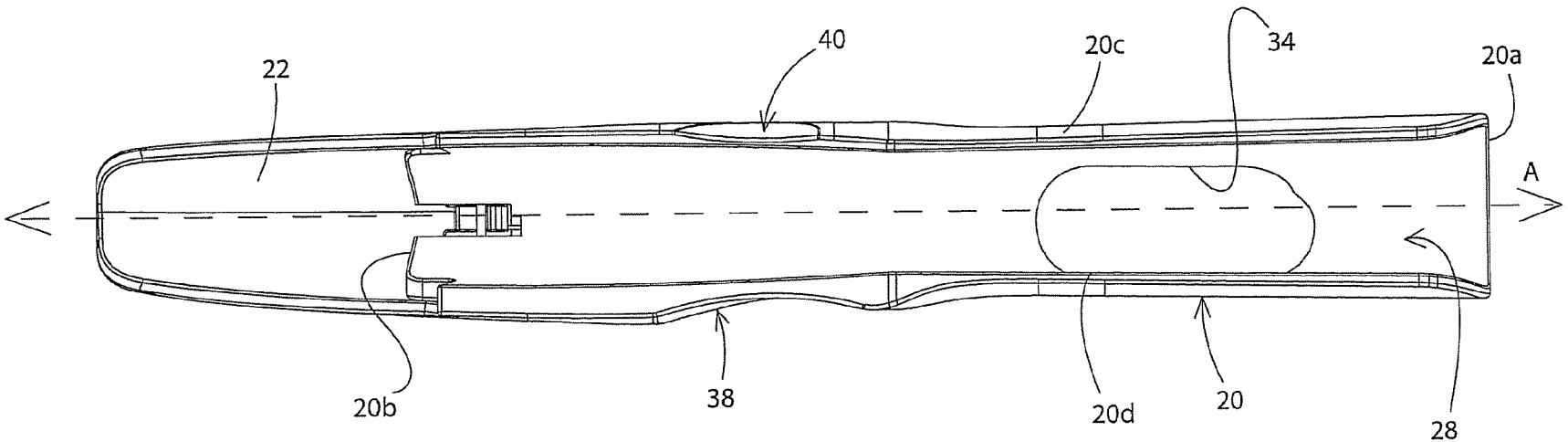
FIG. 6 is a rear view of the golf training aid of FIG. 3.
Figure 7:
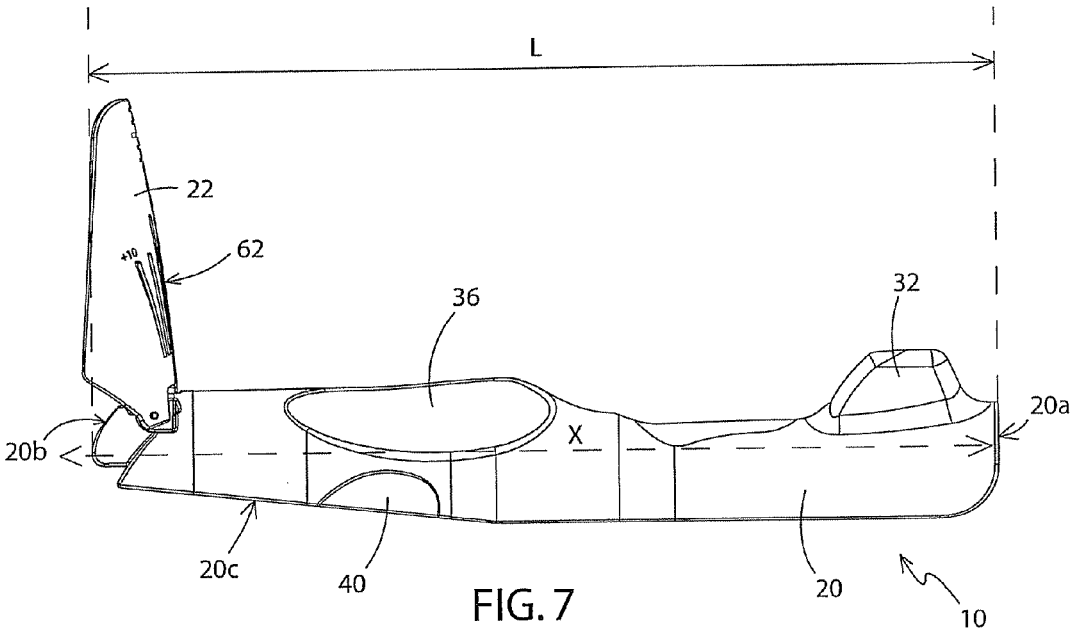
FIG. 7 is a left side view of the golf training aid with the pop-up member in a "flipped up" or non-play position.
Figure 8:
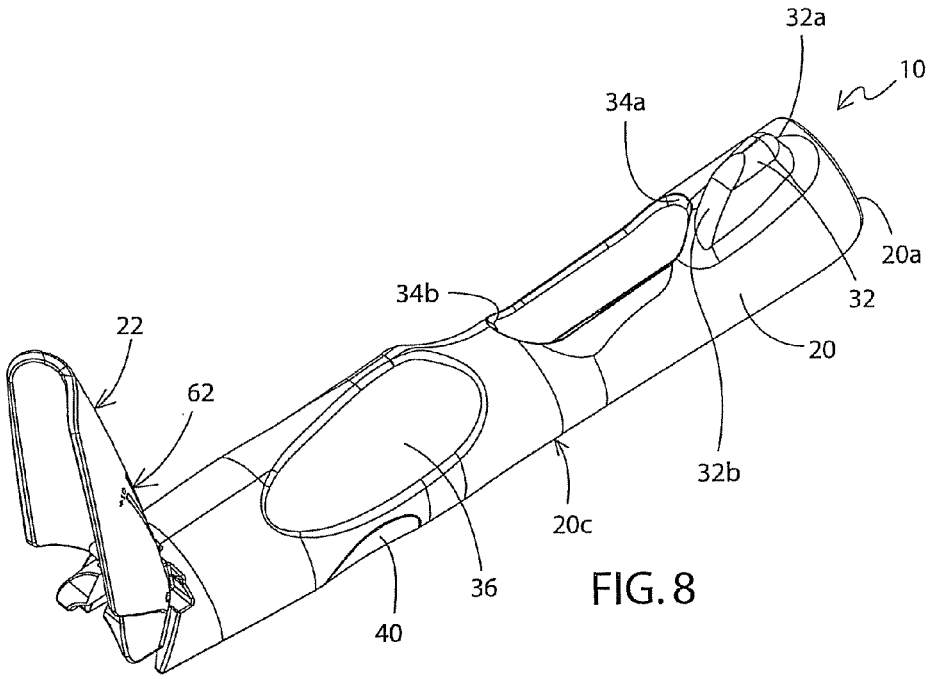
FIG. 8 is a perspective view of the golf training aid shown in FIG. 7.
Figure 9:
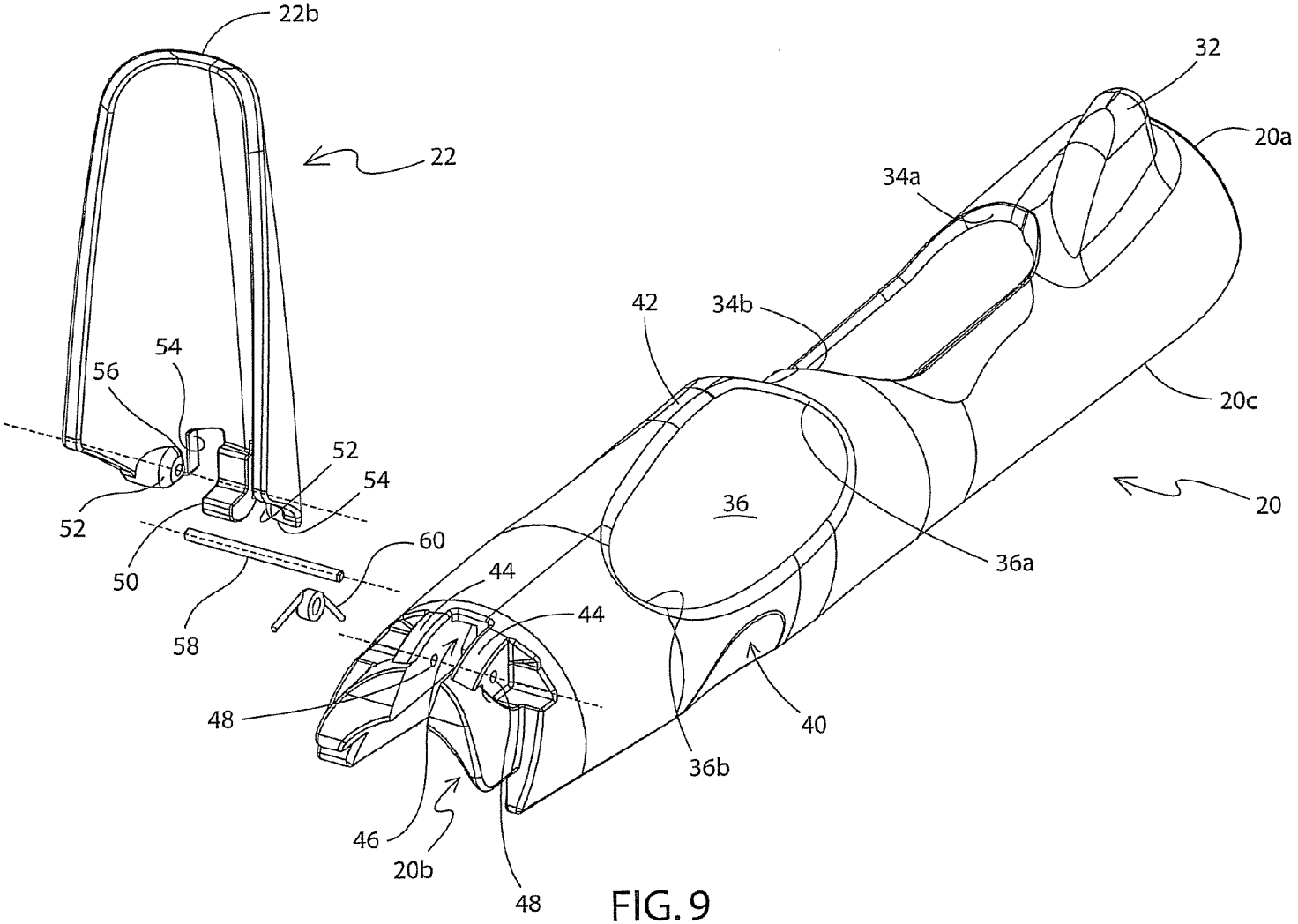
FIG. 9 is a perspective view of the golf training aid with the exploded away from the body thereof.
Figure 11:
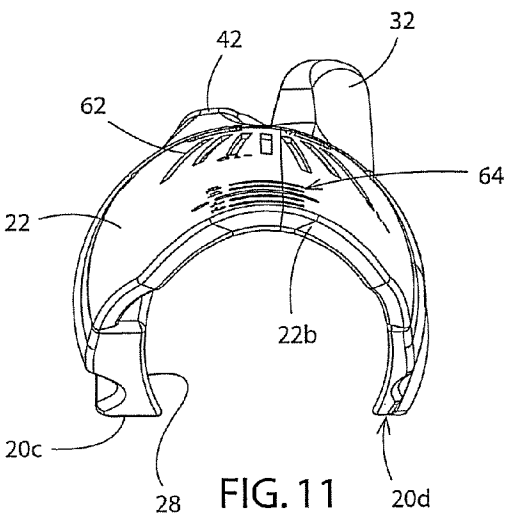
FIG. 11 is a bottom end view of the golf training aid with the pop-up member in the play position.
Figure 10:
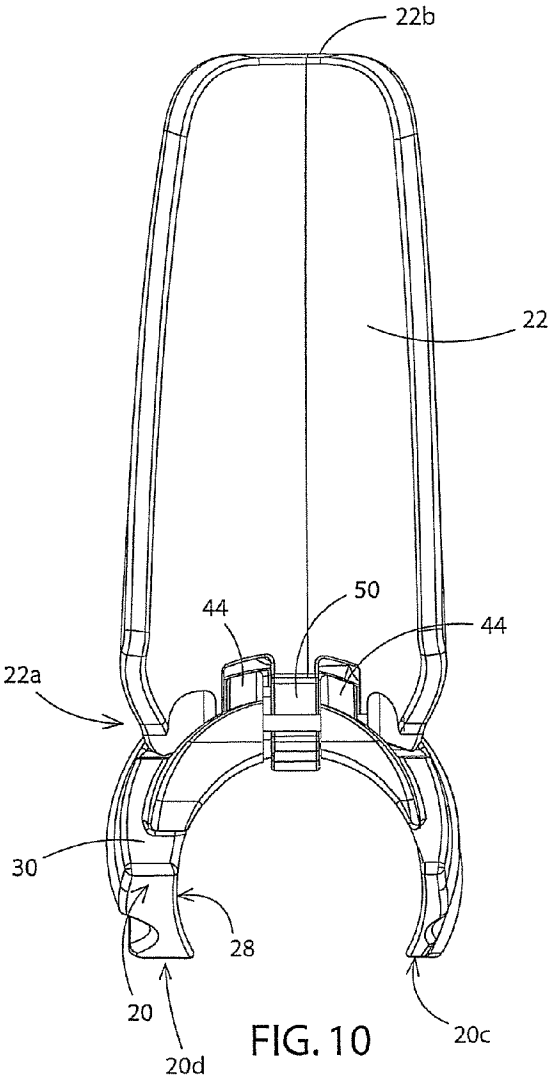
FIG. 10 is a top end view of the golf training aid with the pop-up member in the non-play position and showing the connection between the pop-up member and the body.
Figure 12:
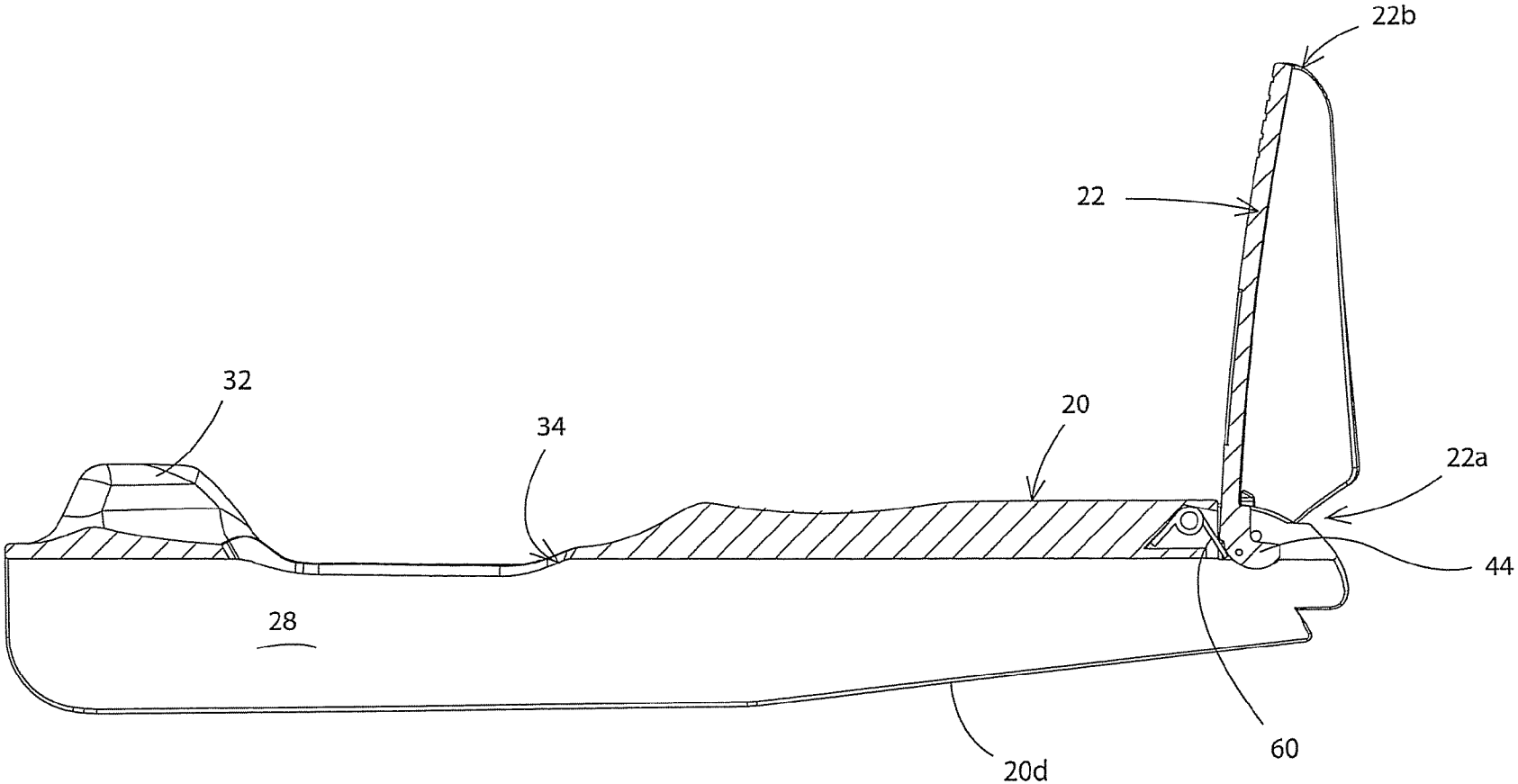
FIG. 12 is a right side view sectional view of the golf training aid with the pop-up member in the non-play position.

In order to engage golf training aid 10 on grip 12, pop-up member 22 is moved into the play position (FIG. 2). The first end 20*a* of body 20 is positioned adjacent a lower end 70 of grip 12 and body 20 is pushed inwardly to snap-fittingly engage outer surface 12*a* of grip 12. Grip 12 is received within the C-shaped channel formed by interior surface 28 of training aid 10. Body 20 is slidingly moved in the direction of arrow "A" (FIG. 1) along exterior surface 12*a* of grip 12 and toward uppermost end 26. Grip 12 is tapered from uppermost end 26 down toward lower end 70. Consequently, as body 20 slides along grip 12, body 20 becomes frictionally engaged therewith and is thereby retained on club 14. Training aid 10 is moved in the direction of arrow "A" until primary indicator line 64*a* is aligned with lower end 70 of grip. This places training aid 10 at a set and repeatable position on grip 12. Should the golfer decide that he wishes to raise or lower training aid 10 on grip 12, training aid can be moved in the direction of arrow "A" or in the opposite direction thereto until the desired one of the other second lines 64*b*, 64*c* is aligned with lowermost end 70. The golfer then needs to only remember which of the second lines is aligned with lowermost end 70 to enable him or her to consistently position training aid 10 on grip 12. It will be understood that changing the second line that is aligned with lowermost end 70 of grip 12 will adjust the angle of the heel relative to the ground and will therefore change the golfer's swing accordingly.

Figure 13:
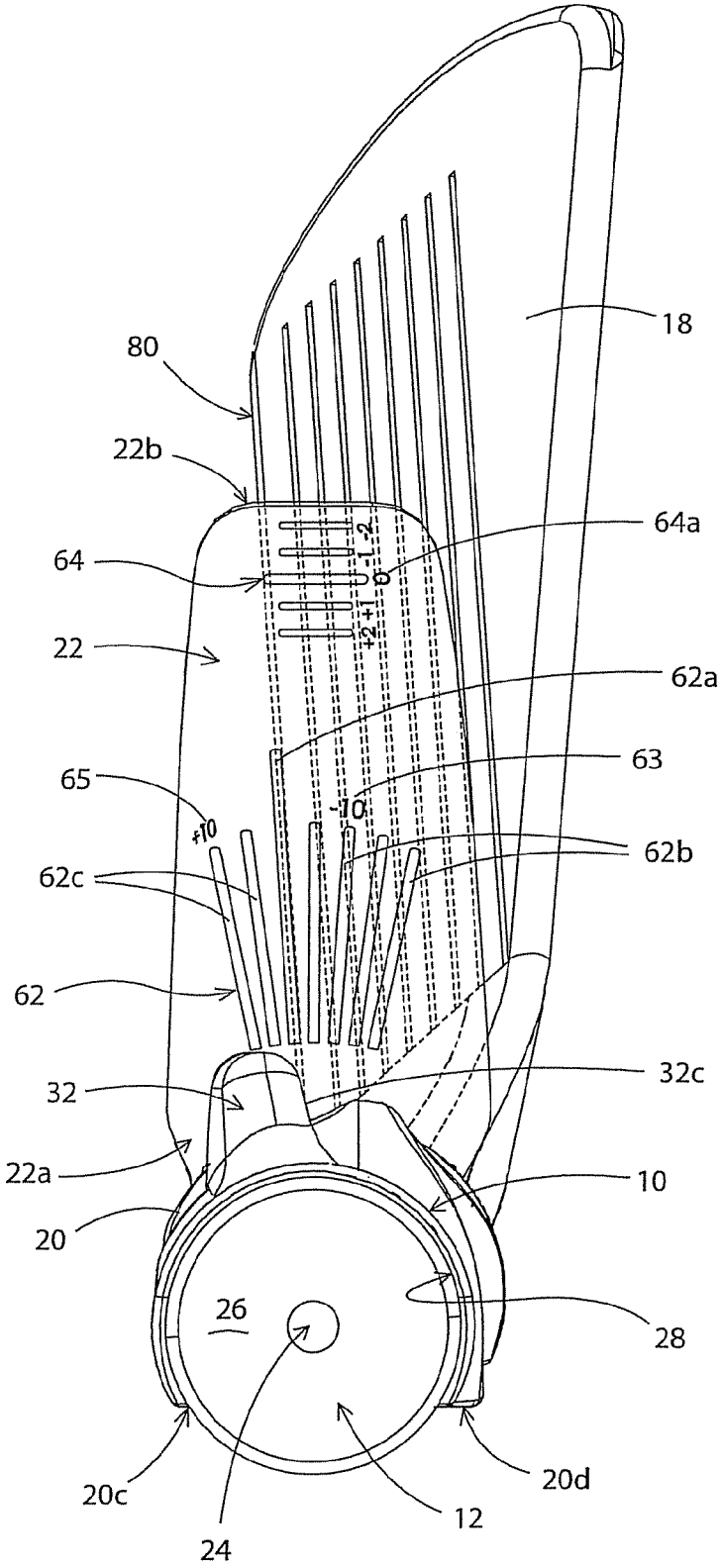
FIG. 13 is a top view of the golf club showing the training aid engaged therewith and showing the pop-up member on the training aid in a non-play position.
Figure 14:
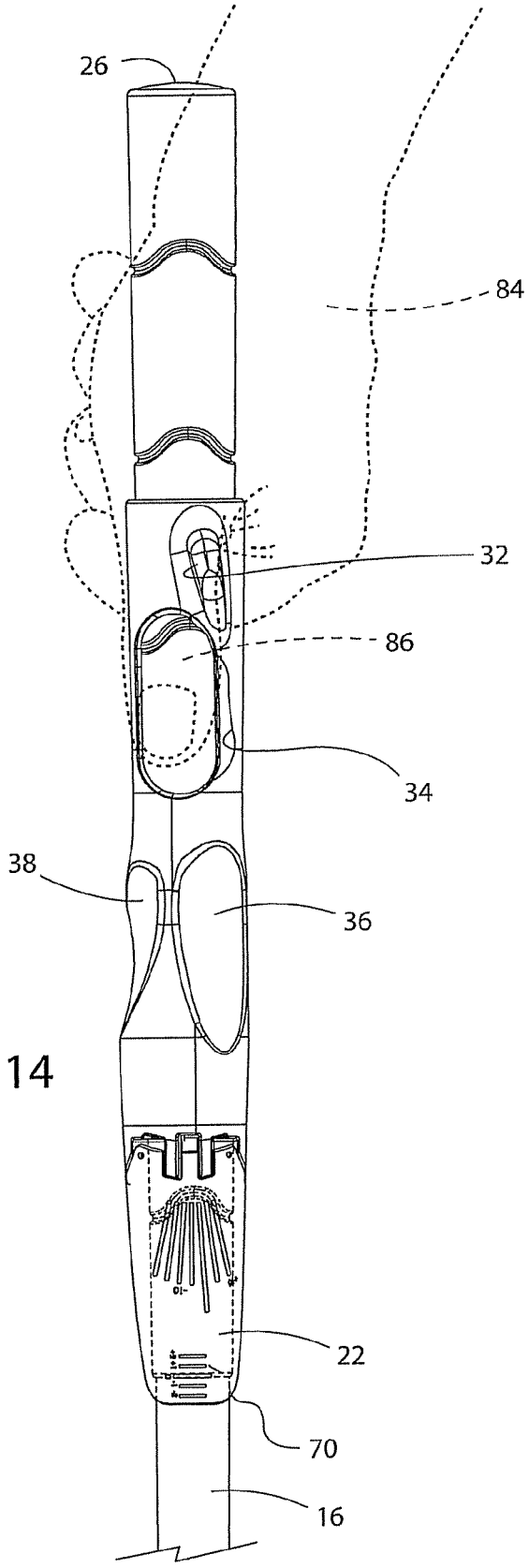
FIG. 14 is a front view of the golf training aid engaged on the grip and showing the placement of the upper hand of the golfer thereon.
Figure 15:
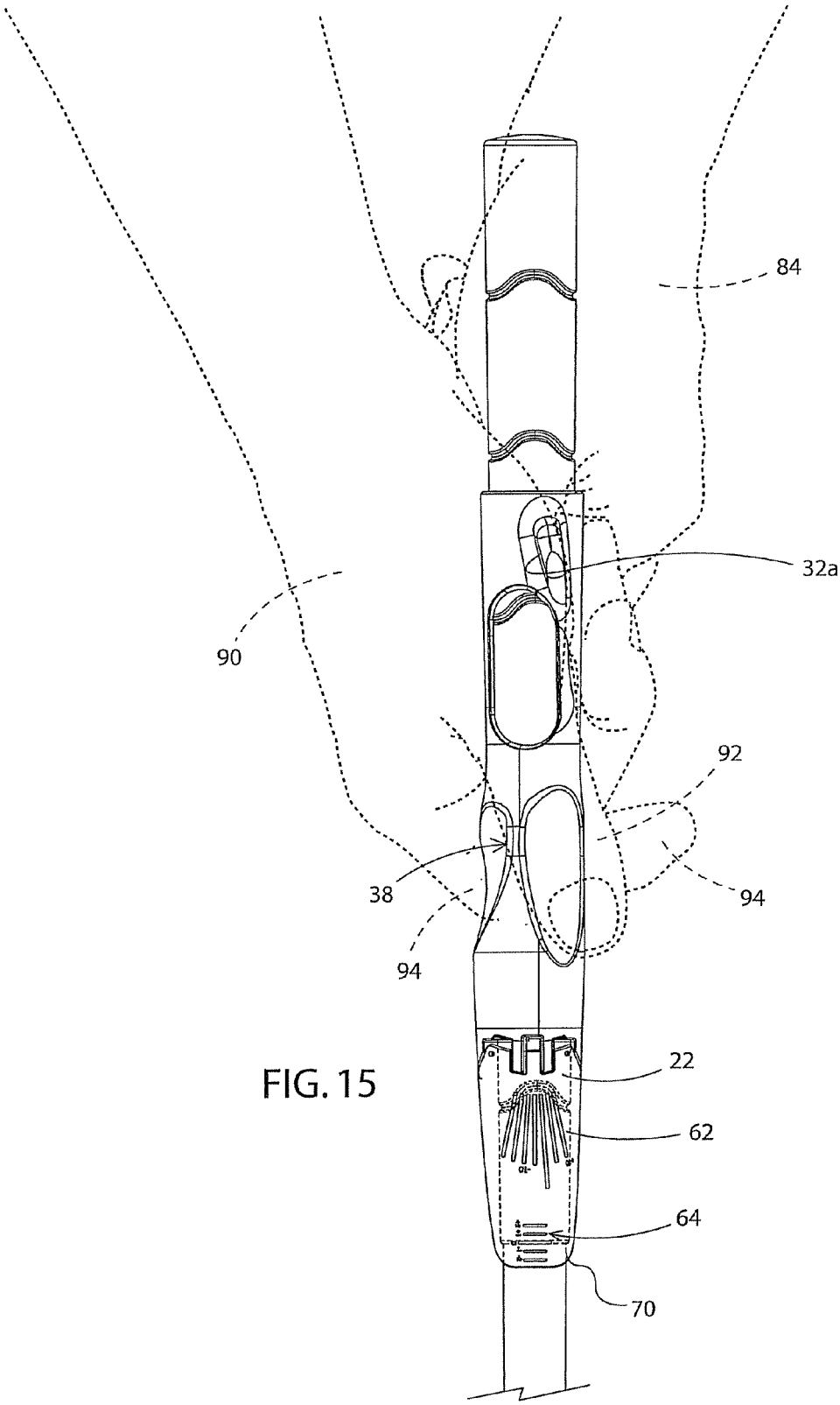
FIG. 15 is a front view of the golf training aid of FIG. 14 with the lower hand placed thereon and with the pop-up member in a play position.
Figure 16:
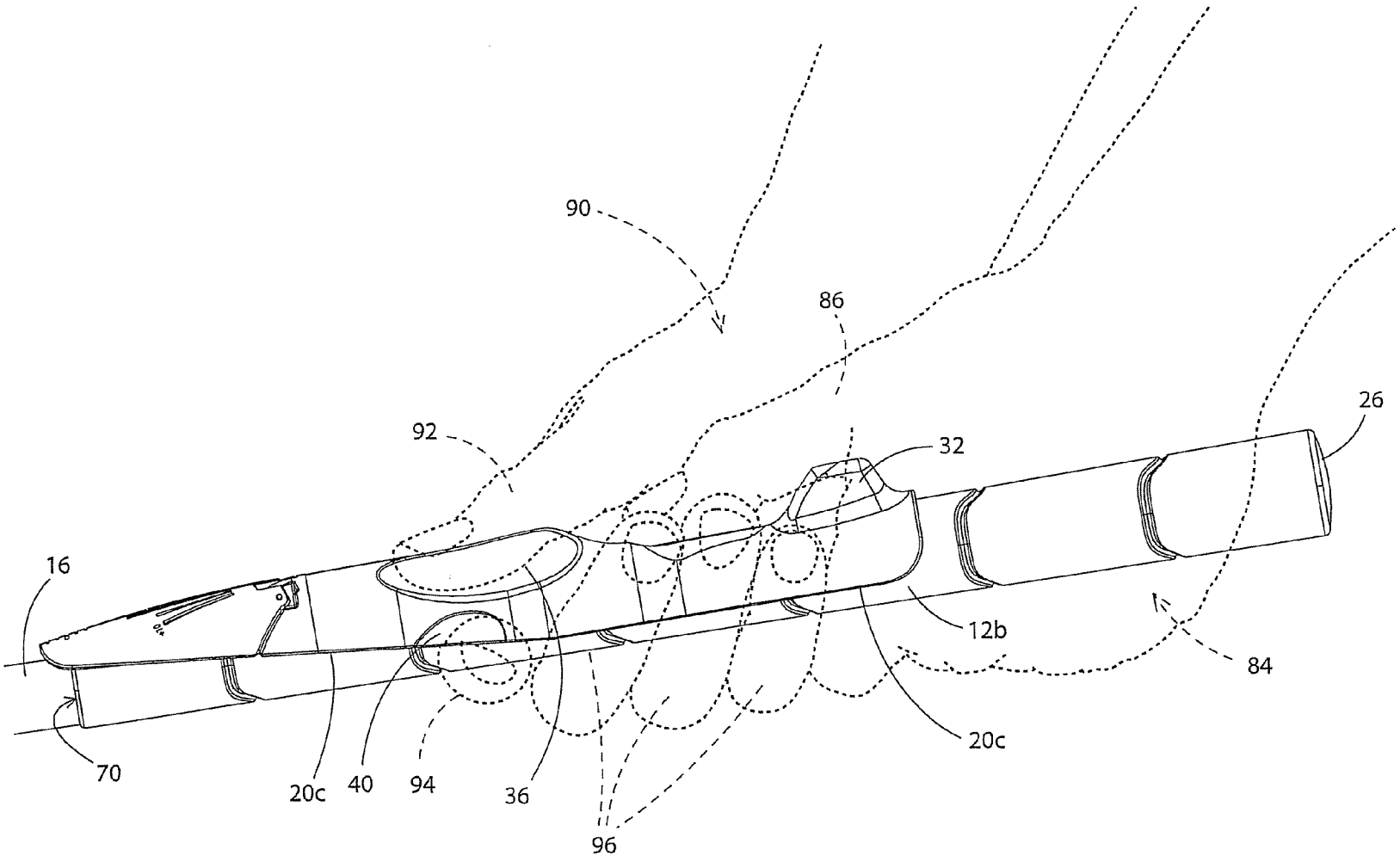
FIG. 16 is a left side view of the golf training aid gripped by the upper and lower hands and with the pop-up member in the play position.
Figure 17:
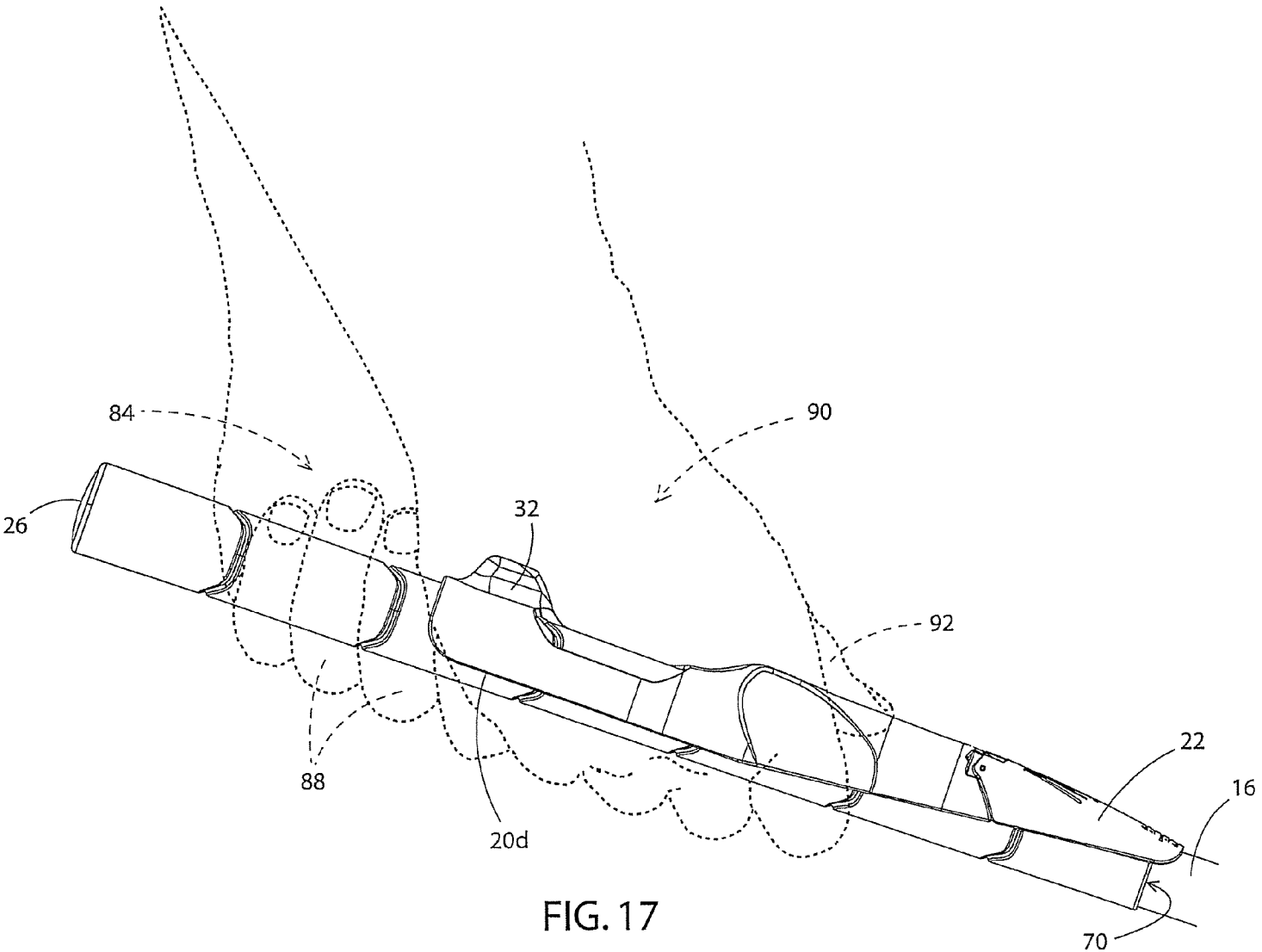
FIG. 17 is a right side view of the golf training aid of FIG. 16.
Figure 18:
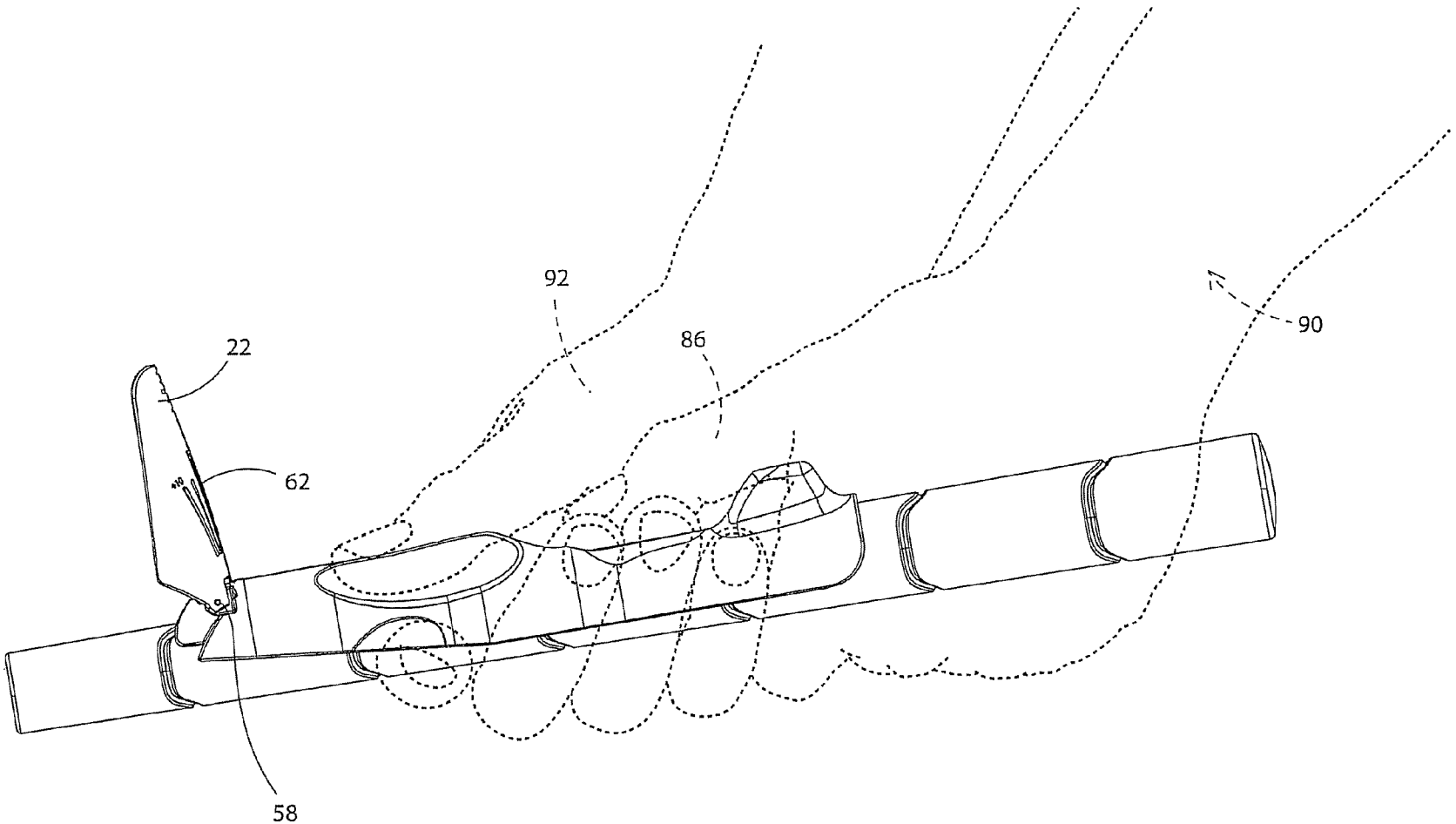
FIG. 18 is a left side view of the golf training aid gripped by the upper and lower hands and with the pop-up member in a non-play position.
Figure 19:
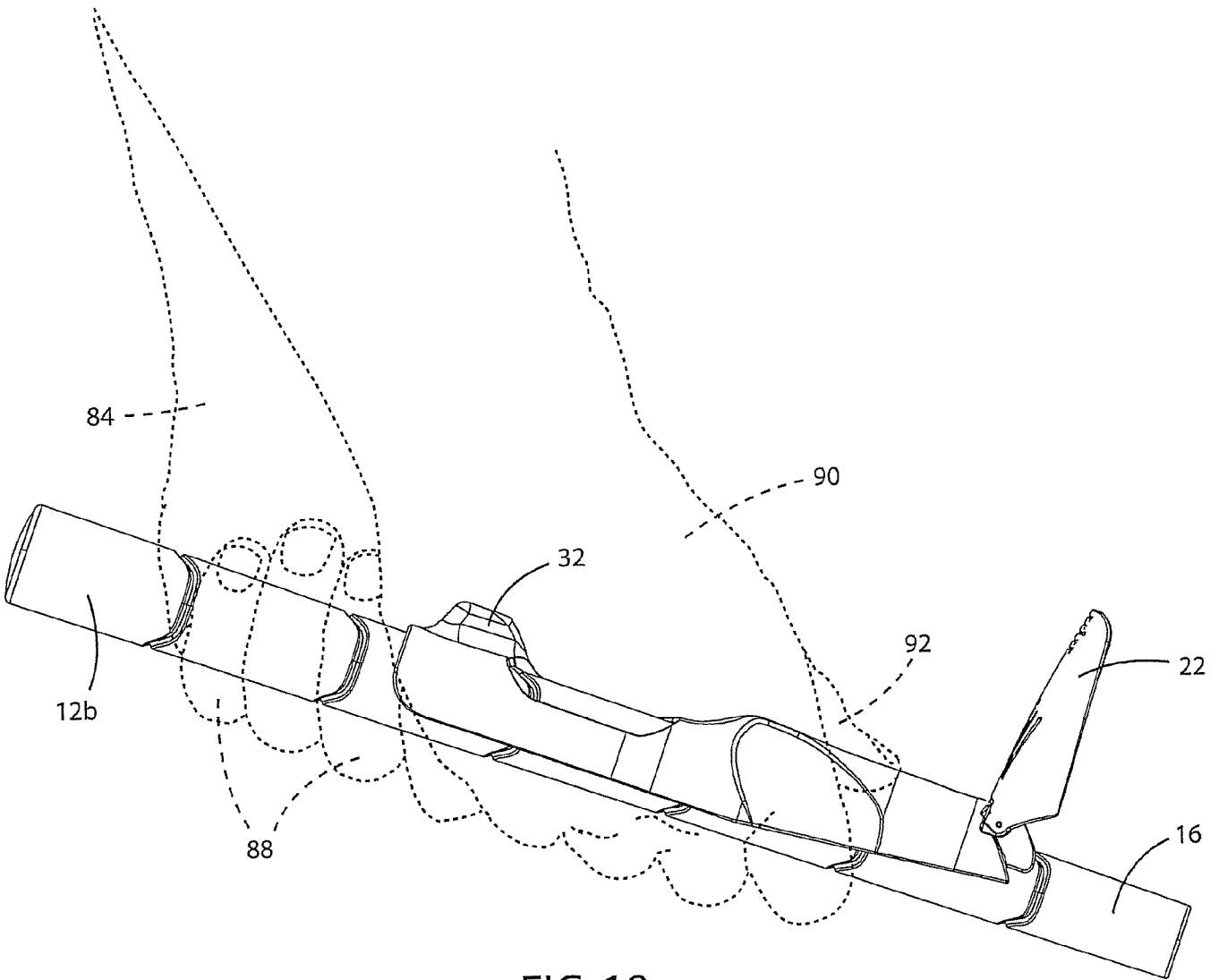
FIG. 19 is a right side view of the golf training aid of FIG. 18.
Figure 20:
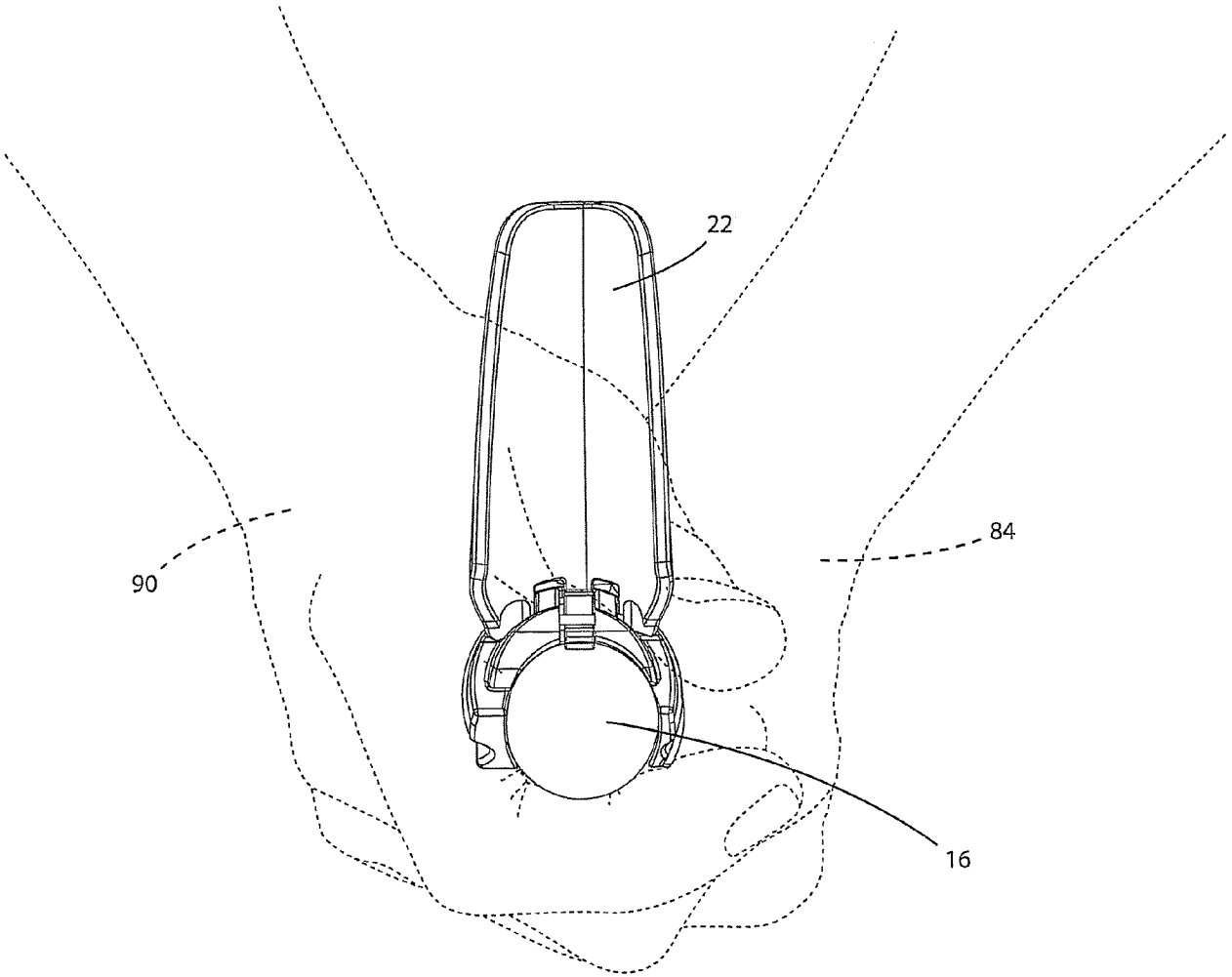
FIG. 20 is a bottom end view of the golf club and golf training aid of FIG. 18 where the shaft is cut through a short distance from the training aid.

The golfer then has to set the position of the training aid 10 on the circumferential surface of grip 12 so that when the golfer holds club 14, the rotation of the golfer's hands relative to the heel of club 14 will be correct. In order to do this, the golfer moves pop-up member 22 from the position shown in FIG. 2 to the position shown in FIG. 7. Pop-up member 22 therefore pivots from the play position where it is substantially coplanar with exterior surface 30 of body, to the non-play position where it is disposed substantially at right angles to exterior surface 30 and to longitudinal axis "X" of body 20. FIG. 13 shows the view the golfer will see when he or she looks at the head 18 of club 14 through the transparent pop-up member 22. Pop-up member 22 includes the plurality of first indicator lines 62 that are selectively alignable with the front face 80 of club head 18. The position of training aid 10 on the circumference of grip 12 may be changed by grasping body 20 with one hand and rotating device 10 around at least a portion of the circumference of grip 12. This rotational motion allows the golfer to align any one of the first indicator lines 62 with front face 80 which sets the training aid 10 in a particular orientation relative to the heel of the club 14. Consequently, when the golfer positions his or her hands around training aid 10, their hands will have a particular orientation relative to the heel of the club and this orientation will affect the way they hit the ball. Preferably, training aid 10 should be positioned so that primary first indicator line 62*a* is aligned with front face 80 as shown in FIG. 13. This position of training aid 10 on grip 12 places the golfer's hands in the neutral position relative to the heel of club 14. When the golfer grips the club and strikes the ball when his or her hands are in this neutral position, the flight of the ball should be straight and true.

Training aid 10 may, alternatively, be positioned on the circumference of the grip 12 so that another of the first indicator lines 62*b*, 62*c* is aligned with front face 80. This is accomplished by rotating body 20 around the circumference of grip 12 in one of two directions until the desired one of the other indicator lines 62*b* or 62*c* is aligned with the face 80 of the club. This different one of the first indicator lines 62*b*, 62*c* could be selected to correct a known problem in the golfer's game. So, for example, if the golfer knows that he or she habitually slices or hooks the ball, they will position the training aid 10 so that an appropriate one of the first indicator lines 62*b* or 62*c* is aligned with front face 80. Then, when they grasp club 14, their hands will be positioned and oriented differently to the way they would normally grip the club and the slicing or hooking of the ball will be at least somewhat corrected. If the hooking or slicing issue is not adequately addressed, the golfer can adjust the position of training aid 10 on grip 12 once again to bring another of lines 62*b*, 62*c* into alignment with front face 80. This will again change the position of the golfer's hands relative to the heel of the club and will assist in correcting their tendency to hook or slice the ball. When training aid 10 is positioned so that the golfer hits the ball straight instead of hooking or slicing the same, then the golfer may note which one of the first indicator lines 62*b*, 62*c* is aligned with front face 80 and can then consistently place the training aid 10 in that position when they practice. Over a period of time, the tendency to hook or slice a ball will tend to disappear from their game.

Once pop-up member 22 has been used to correctly position training aid 10 circumferentially on grip 12 and relative to club head 14, the golfer pivots pop-up member 22 from the non-play position into the play position. The golfer places his or her hands around training aid 10 and grip 12 in order to hold club 14. Because the figures illustrate a right-handed golfer gripping club 14, the golfer positions his or her left hand (the upper hand) 84 first on training aid 10. This is done by placing the left thumb 86 in aperture 34 so that the surface of left thumb 86 rests on the exterior surface 12*a* of grip 12. The inner side region of left thumb 86 is positioned so that it abuts surface 32*a* of protrusion 32. The golfer wraps the fingers 88 of his or her left-hand 84 around the uncovered region 12*b* of grip 12 and possibly back into partial contact with a side region of body 20 adjacent second side edge 20*d*. The right or lower hand 90 is then positioned around training aid 10 and grip 12. This is accomplished by placing the right thumb 92 onto first pad 36 and placing the right index finger 94 onto second pad 38 and wrapping it around grip 12 until the tip thereof rests in third pad 40. The remaining fingers 96 of right-hand 90 wrap around the uncovered region 12*b* of grip 12 and back into contact with training aid 10 in the region of first side edge 20*c*. Training aid 10 has hereby correctly positioned the hands 84, 90, thumbs 86, 92 and fingers 88, 94, 96 on grip 12 and the golfer may now use club 14 to play the stroke. Because training aid 10 was correctly positioned relative to the heel of the club prior to the golfer positioning their hands, the rotation of the hands relative to the heel is preset and is repeatable. Consistent use of training aid 10 will retrain the golfer's muscle memory and ultimately, through repetitive use, the golfer will correctly grip his club 14 and will play a much improved game.

Figure 26:
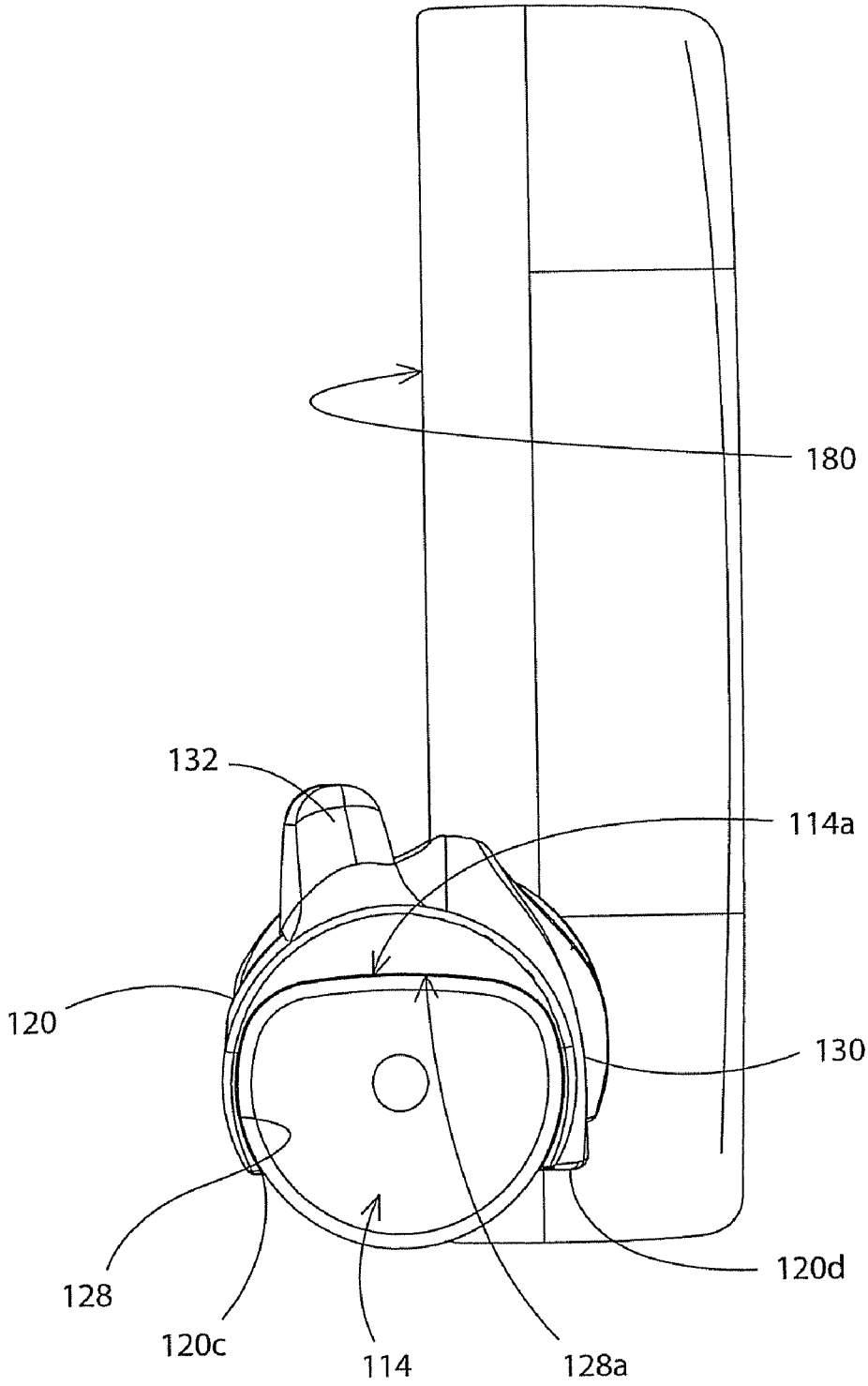
FIG. 26 is a top view of the golf putter showing the second embodiment of the golf training aid engaged therewith and showing the planar surface on the training aid being complementary configured and seated on a planar face of the putter's grip.

Referring to FIGS. 21-26, there is shown a second embodiment of a training aid in accordance with the present invention and generally indicated at 110. Training aid 110 is designed for use in association with non-full-swing golf clubs such as a putter 114. Training aid 110 comprises a body 120 having a proximal end 120*a*, a distal end 120*b*, first and second side edge 120*c*, 120*d* and interior and exterior surfaces 128, 130. As shown in FIG. 26, putters 114 are manufactured with a planar face 114*a* that is oriented substantially at right angles to the putting face 180 thereof. Body 120 of training aid 110 is designed to be configured complementary to grip 112 on putter 114 and specifically to be configured so that it has a positioning indicator that automatically sets body 20 in a neutral position relative to the heel of the putter 114. To that end, interior surface 128 is provided with a positioning indicator in the form of a planar face 128*a* complementary to planar face 114*a* of putter 114. Thus, there is only one orientation by which body 120 may be received and engaged on grip 112. Training aid 110 is therefore always in the correct neutral position on putter 114. Training aid 110 is engaged with putter 114 in a substantially identical manner as training aid 10 is engaged with club 14, with the exception that the planar face 128*a* of body 120 is aligned with the planar face 114*a* of putter 114 before body 120 is slidingly moved along grip 112 in the direction of arrow "A" so as to become frictionally engaged therewith.

Body 120 of training aid 110 is configured to correctly position the hands, fingers and thumbs of the golfer on grip 112. To that end, body 120 is provided with a protrusion 132 proximate proximal end 120*a* and a recessed region 135 adjacent thereto. Recessed region 135 is configured to receive the left thumb (not shown) of the golfer therein. Body 120 is further provided with first, second and third pads 136, 138 and 140 that are configured to respectively receive the right thumb, a portion of the right index finger and the tip of the right index finger therein. Each of these first, second and third pads 136, 138, 140 is positioned and oriented in substantially an identical location and manner to the first, second and third pads 36, 38 and 40 on training aid 10.

Figure 21:
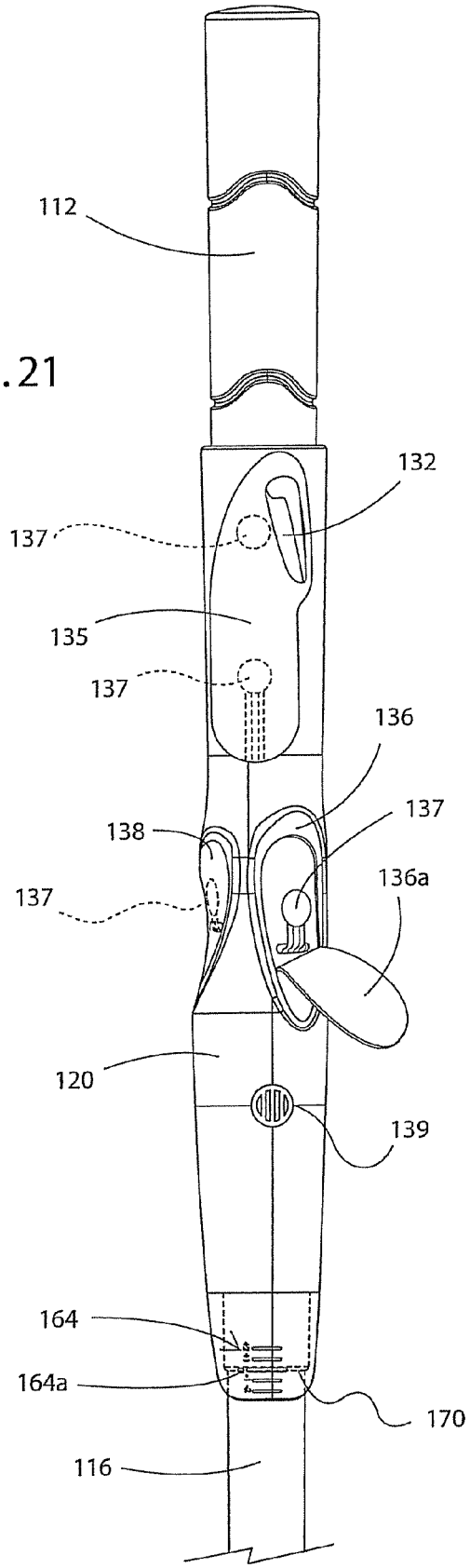
FIG. 21 is a front view of a second embodiment of a golf training aid in accordance with the present invention and shown engaged with the grip of a golf putter. One of the rubber pads on the device is shown partially detached to reveal a pressure sensor disposed beneath the pad.
Figure 22:
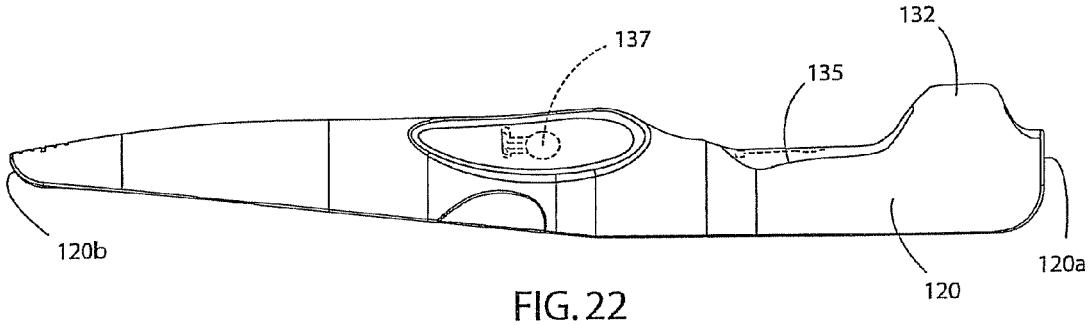
FIG. 22 is a left side view of the second embodiment of the golf training aid in accordance with the present invention.
Figure 23:
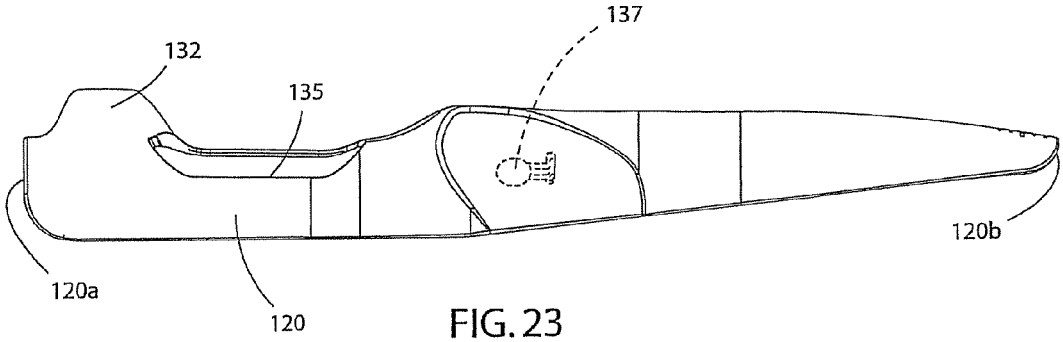
FIG. 23 is a right side view of the golf training aid of FIG. 22.
Figure 24:
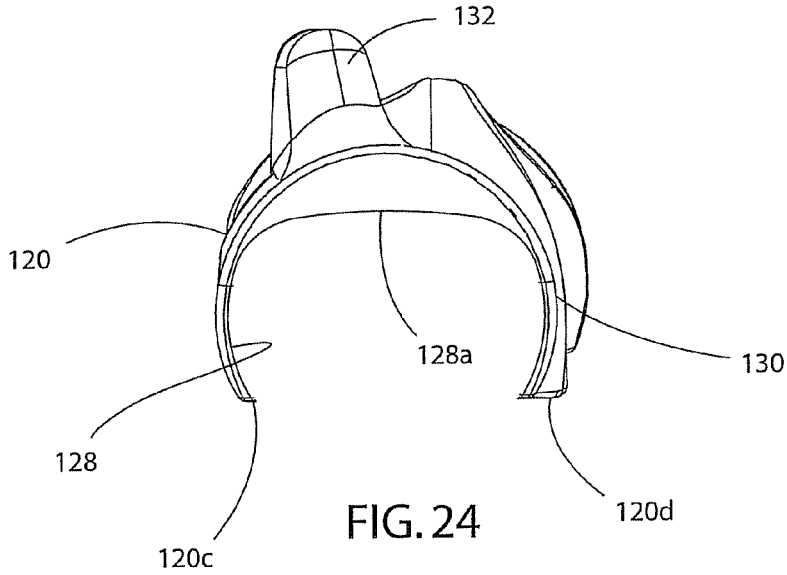
FIG. 24 is a rear view of the golf training aid of FIG. 22.
Figure 25:
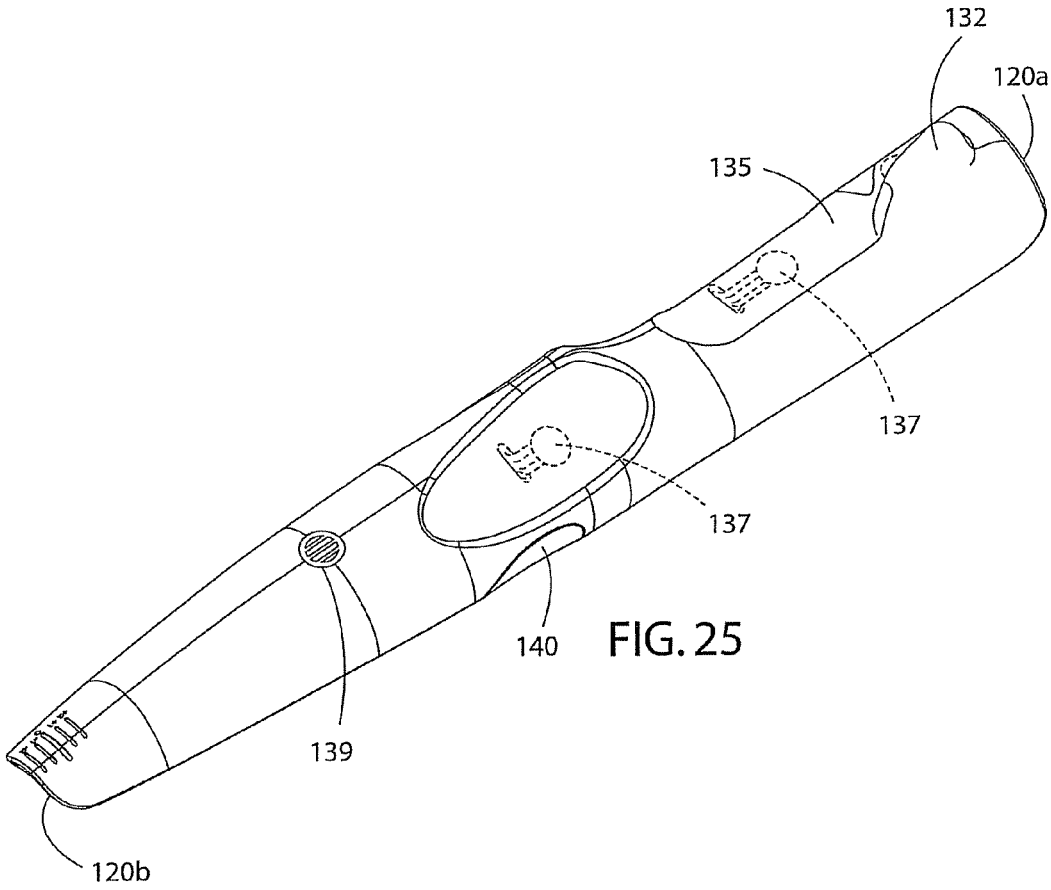
FIG. 25 is a perspective view of the training aid of FIG. 22.

In accordance with a specific feature of the present invention, each of the recessed region 135 and first, second and third pads 136, 138, 140 are constructed in a similar manner to each other. Body 120 is molded from a flexible plastic as was the case with the first embodiment. However, each of recessed region 135, first, second and third pads 136, 138, 140 further includes a rubber overlayer that is secured to the plastic of body 120. FIG. 21 shows the rubber overlayer 136*a* of first pad 136 pulled away therefrom. In accordance with another specific feature of the present invention, each of recessed region 135 and first, second and third pads 136, 138, 140 is provided with a pressure sensor 137 that is positioned beneath the rubber overlayer. Each pressure sensor 137 is connected, either through hard wiring or through wireless connections, to a speaker 139. Pressure sensors 137 are preset so that if a predetermined threshold of pressure is detected that an audible sound will be emitted from speaker 139 to alert the golfer to adjust the strength of his grip on club 114.

As with the previous embodiment, training aid 110 is provided with a clear pop-up member region 122 proximate distal end 120 thereof. Pop-up member region 122 differs from pop-up member 22 in that it is not articulated to body 120 and therefore cannot be pivoted relative thereto. Instead, pop-up member region 122 is fixedly coplanar with body 120. Pop-up member region 122 does not need to pivot, however, in that planar face 128*a* of body 120 complementary engages planar face 114*a* of putter 114 and thereby correctly orients training aid 110 on putter 114. Training aid 110 does, however, still need to be correctly positioned linearly on grip 112 relative to the axis "Y" of the putter 114. To that end, pop-up member region 122 is provided with a plurality of linear indicators 164 that are oriented at right angles to longitudinal axis "Y". When training aid 110 is engaged on putter, the golfer slides body 120 along grip 112 and in the direction of arrow "A" until the primary linear indicator 164*a* is aligned with the inner end 170 of grip 112 and adjacent shaft 116 as previously described with respect to training aid 10. Other of the indicator lines 64 may, however, be selected to alter the position of the hands relative to the linear axis of the putter 114.

Training aid 110 is engaged with putter 114 and used in much the same manner as training aid 10 on club 14. Finger pressure has been a long sought-after feature in golf training aids. It is difficult to determine where the center of the key gripping fingers and thumbs should be on grip 112. The training aid 110 of the present invention is sized appropriately for the hand of the user. Training aid 110 is manufactured for left-handed and right-handed adult males, left-handed and right-handed adult females, as well as for left-handed and right-handed male and female youths. The golfer simply has to select the appropriate size device and then the location of the various features of training aid 110 will result in the golfer correctly gripping training aid 110 and grip 112 in an accurate and repeatable fashion.

When golfer grips training aid 110 around grip 112 of putter 114, pressure sensors 137 are activated. If, as mentioned previously, the incorrect pressure is applied to any one of the sensors 137, an audible sound is emitted from speaker 139 to alert the golfer to alter his grip on device 110. The sound(s) will be emitted from speaker 139 until the golfer adjusts his grip on device 110.

It will be understood that pressure sensors 137 and a recessed region 135 with a rubber overlay may be utilized instead of aperture 134 on training aid 10 without departing from the spirit of the present invention. Similarly, it should be understood that an aperture may be provided in training aid 110 without departing from the spirit of the present invention.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention are an example and the invention is not limited to the exact details shown or described.

The invention claimed is:

1. A method of training a golfer to correctly position their hands on a golf club, where the club includes a head having a ball-striking face, a shaft and a grip; and said method includes the steps of:

a) engaging a training aid on an exterior circumferential surface of the grip;

b) utilizing a first apparatus on the training aid to correctly position the training aid on the exterior surface of the grip by:

i) selecting one of a plurality of lines marked on a transparent member of the training aid;

ii) looking through the transparent member at the ball-striking face of the club;

iii) rotating the training aid circumferentially around the exterior surface of the grip until the selected one of the lines is visually aligned with the ball-striking face of the club; and c) playing a stroke using the club.

2. The method as defined in claim 1, wherein after aligning the selected one of the lines with the ball-striking face of the club, the step of utilizing the first apparatus further comprises the step of:

sliding the training aid longitudinally along the exterior surface of the grip and toward the uppermost end thereof until further longitudinal movement of the training aid is arrested.

3. The method as defined in claim 1, wherein the step of selecting one of the plurality of lines marked on the transparent member includes the steps of:

determining whether the golfer typically hooks a golf ball, slices the golf ball or plays neutral strokes;

selecting a first one of the plurality of lines when it is determined that the golfer typically hooks the golf ball when playing a stroke; where the first line extends along the transparent member in a first direction;

selecting a second one of the plurality of lines when it is determined that the golfer typically slices the golf ball when playing a stroke; where the second line is disposed adjacent the first line and extends along the transparent member in a second direction; and selecting a third one of the plurality of lines when it is determined that the golfer typically plays neutral strokes; where the third line is disposed adjacent one or both of the first and second lines and extends along the transparent member in a third direction.

4. The method as defined in claim 1, wherein the step of looking through the transparent member is preceded by the steps of:

rotating the transparent member from a first position where it is substantially aligned with a housing of the training aid and in contact with the exterior surface of the grip to a second position where it extends outwardly away from the housing and at an angle thereto and is out of contact with the exterior surface of the grip.

5. The method as defined in claim 4, wherein the step of playing a stroke with the club is preceded by the step of:

rotating the transparent member from the second position back into the first position.

6. The method as defined in claim 1, further comprising the steps of:

d) utilizing a second apparatus on the training aid to assist in correctly positioning one of the golfer's hands as the uppermost hand on the training aid and to correctly position the other of the golfer's hands as the lowermost hand on the training aid;

e) holding the training aid against the grip with the uppermost and lowermost hand correctly positioned.

7. The method as defined in claim 6, further comprising the step of:

periodically repeating steps a) through e) until the golfer's muscle memory is trained to correctly position the uppermost and lowermost hands on the club's grip.

8. The method as defined in claim 6, wherein the step of utilizing the second apparatus comprises the steps of:

resting an interior side of the thumb of the golfer's uppermost hand against a protrusion that extends outwardly away from an exterior surface of the training aid; and wrapping the fingers of the upper hand around the training aid and a first portion of the grip.

9. The method as defined in claim 6, wherein the step of resting the thumb of the uppermost hand further includes the step of:

placing a bottom portion of the thumb into an aperture disposed adjacent the protrusion such that the bottom portion of thumb contacts the exterior surface of the grip.

10. The method as defined in claim 9, wherein the step of using the second apparatus further includes the step of:

resting an interior side of the thumb of the lowermost hand against a second protrusion that is generally aligned with a centerline of the training aid and adjacent an end of the aperture remote from the first protrusion;

placing the heel of the lower hand onto an upper surface of the thumb of the uppermost hand and wrapping the fingers of the lowermost hand around the training aid and a second portion of the grip.

11. The method as defined in claim 10, wherein the step of resting the thumb of the lowermost hand against the second projection further includes:

placing a bottom portion of the thumb of the lowermost hand into a first depression formed on one side of the second protrusion prior to wrapping the fingers of the lowermost hand around the training aid and the grip.

12. The method as defined in claim 11, further comprising: positioning a bottom portion of the index finger of the lowermost hand into a second depression formed on the other side of the second projection prior to wrapping the fingers of the lower hand around the training aid and the grip.

13. The method as defined in claim 1, further comprising the step of holding the training aid against the grip with sufficient force to activate at least one pressure sensor in the training aid.

14. A method of using a golf training aid to correctly position the hands on the grip of a golf club, where the club includes a head with a ball-striking face, and the method comprises the steps of:

providing a golf training aid comprising an elongate member generally C-shaped in cross-section having a proximal end, a distal end, a first side edge and a second side edge extending between the proximal and distal ends and defining a gap thereinbetween, an interior surface, an exterior surface; a positioning aid provided on the exterior surface and at least one positioning indicator marked on the positioning aid;

engaging the training aid on an exterior surface of the grip;

aligning the at least one positioning indicator marked on the positioning aid with the ball-striking face of the club;

placing a first hand on the training aid and wrapping the fingers of the first hand around a first portion of the training aid and the grip;

placing a second hand on the training aid and wrapping the fingers of the second hand around a second portion of the training aid and the grip; and playing a stroke with the training aid retained against the exterior surface of the grip by the first and second hands.

15. The method as defined in claim 14, wherein the step of engaging the training aid on the grip includes:

snap-fitting the elongate member onto the grip such that a portion of an exterior surface of the grip is received within the gap of the elongate member and the interior surface of the training aid abuts the portion of the exterior surface of the grip;

sliding the training aid longitudinally along the exterior surface of the grip until a horizontal region of the training aid proximate the distal end thereof is aligned with an innermost edge of the grip adjacent the shaft; and rotating the training aid circumferentially around the exterior surface of the grip until the at least one positioning indicator on the positioning aid is aligned with the ball-striking face.

16. The method as defined in claim 14, wherein the step of aligning the at least one positioning indicator with the ball-striking face is preceded by the step of:

rotating the positioning aid from a play position where it is in abutting contact with the exterior surface of the grip to a non-play position where it extends outwardly from the exterior surface of the grip and at an angle thereto.

17. The method as defined in claim 16, wherein the step of rotating the positioning aid from the play position to the non-play position includes the steps of:

grasping the positioning aid when it is disposed in abutting contact with the exterior surface of the grip; and pivoting the positioning aid about a pivot until it is disposed substantially at right angles to the exterior surface of the grip.

18. A method of using a golf training aid to correctly position the hands on the grip of a golf club, where the club includes a head with a ball-striking face, and the method comprises the steps of:

providing a golf training aid comprising an elongate member generally C-shaped in cross-section having a proximal end, a distal end, a first side edge and a second side edge extending between the proximal and distal ends and defining a gap thereinbetween, an interior surface, an exterior surface; a positioning aid provided on the exterior surface and at least one positioning indicator marked on the positioning aid;

engaging the training aid on an exterior surface of the grip;

aligning the at least one positioning indicator marked on the positioning aid with the ball-striking face of the club by:

looking through a transparent region of the positioning aid to determine the relative position of the ball-striking face;

rotating the training aid circumferentially around the exterior surface of the grip while looking through the transparent region; and ceasing rotation of the training aid when the at least one positioning indicator disposed on the transparent region is visually aligned with the ball-striking face;

placing a first hand on the training aid and wrapping the fingers of the first hand around a first portion of the training aid and the grip;

placing a second hand on the training aid and wrapping the fingers of the second hand around a second portion of the training aid and the grip; and playing a stroke with the training aid retained against the exterior surface of the grip by the first and second hands.

19. The method as defined in claim 18, the step of selecting one of the plurality of lines marked on the transparent member includes the steps of:

determining whether the golfer typically hooks a golf ball, slices the golf ball or plays neutral strokes;

selecting a first one of the plurality of lines when it is determined that the golfer typically hooks the golf ball when playing a stroke; where the first line extends along the transparent member in a first direction;

selecting a second one of the plurality of lines when it is determined that the golfer typically slices the golf ball when playing a stroke; where the second line is disposed adjacent the first line and extends along the transparent member in a second direction; and selecting a third one of the plurality of lines when it is determined that the golfer typically plays neutral strokes; where the third line is disposed adjacent one or both of the first and second lines and extends along the transparent member in a third direction.

20. The method as defined in claim 18, wherein the step of engaging the training aid on the grip includes:

snap-fitting the elongate member onto the grip such that a portion of an exterior surface of the grip is received within the gap of the elongate member and the interior surface of the training aid abuts the portion of the exterior surface of the grip;

sliding the training aid longitudinally along the exterior surface of the grip until a horizontal region of the training aid proximate the distal end thereof is aligned with an innermost edge of the grip adjacent the shaft; and rotating the training aid circumferentially around the exterior surface of the grip until the at least one positioning indicator on the positioning aid is aligned with the ball-striking face.

21. The method as defined in claim 18, wherein the step of aligning the at least one positioning indicator with the ball-striking face is preceded by the step of:

rotating the positioning aid from a play position where it is in abutting contact with the exterior surface of the grip to a non-play position where it extends outwardly from the exterior surface of the grip and at an angle thereto.

22. The method as defined in claim 21, wherein the step of rotating the positioning aid from the play position to the non-play position includes the steps of:

grasping the positioning aid when it is disposed in abutting contact with the exterior surface of the grip; and pivoting the positioning aid about a pivot until it is disposed substantially at right angles to the exterior surface of the grip.

23. A method of using a golf training aid to correctly position the hands on the grip of a golf club, where the club includes a head with a ball-striking face, and the method comprises the steps of:

providing a golf training aid comprising an elongate member generally C-shaped in cross-section having a proximal end, a distal end, a first side edge and a second side edge extending between the proximal and distal ends and defining a gap thereinbetween, an interior surface, an exterior surface; a positioning aid provided on the exterior surface and at least one positioning indicator marked on the positioning aid;

engaging the training aid on an exterior surface of the grip;

aligning the at least one positioning indicator marked on the positioning aid with the ball-striking face of the club; and positioning the first and second hands by:

placing a first hand on the training aid and wrapping the fingers of the first hand around a first portion of the training aid and the grip;

placing the inside edge of the thumb of the first hand in abutting contact with a first protrusion adjacent an uppermost end of the training aid, placing the bottom of the thumb of the first hand in an aperture in the training aid disposed adjacent the first protrusion, wrapping the fingers of the first hand around the training aid and the grip;

placing a second hand on the training aid and wrapping the fingers of the second hand around a second portion of the training aid and the grip;

placing the inside edge of the thumb of the second hand in abutting contact with a second protrusion disposed adjacent the aperture and remote from the first protrusion;

resting the heel of the second hand on the upper surface of the thumb of the first hand; and playing a stroke with the training aid retained against the exterior surface of the grip by the first and second hands.

24. The method as defined in claim 23, wherein the step of engaging the training aid on the grip includes:

snap-fitting the elongate member onto the grip such that a portion of an exterior surface of the grip is received within the gap of the elongate member and the interior surface of the training aid abuts the portion of the exterior surface of the grip;

sliding the training aid longitudinally along the exterior surface of the grip until a horizontal region of the training aid proximate the distal end thereof is aligned with an innermost edge of the grip adjacent the shaft; and rotating the training aid circumferentially around the exterior surface of the grip until the at least one positioning indicator on the positioning aid is aligned with the ball-striking face.

25. The method as defined in claim 23, wherein the step of aligning the at least one positioning indicator with the ball-striking face is preceded by the step of:

rotating the positioning aid from a play position where it is in abutting contact with the exterior surface of the grip to a non-play position where it extends outwardly from the exterior surface of the grip and at an angle thereto.

26. The method as defined in claim 25, wherein the step of rotating the positioning aid from the play position to the non-play position includes the steps of:

grasping the positioning aid when it is disposed in abutting contact with the exterior surface of the grip; and pivoting the positioning aid about a pivot until it is disposed substantially at right angles to the exterior surface of the grip.

* * * * *